US010138102B2

(12) United States Patent
Baillargeon et al.

(10) Patent No.: US 10,138,102 B2
(45) Date of Patent: Nov. 27, 2018

(54) WARNING AND MESSAGE DELIVERY AND LOGGING SYSTEM UTILIZABLE IN A FALL ARRESTING AND PREVENTION DEVICE AND METHOD OF SAME

(71) Applicants: Paul D. Baillargeon, Suncook, NH (US); Viki V. Walbridge, Arvada, CO (US)

(72) Inventors: Paul D. Baillargeon, Suncook, NH (US); Van Walbridge

( * ) Notice: Subject to any disclaimer, the term of this patent is extended or adjusted under 35 U.S.C. 154(b) by 0 days.

(21) Appl. No.: 14/338,289

(22) Filed: Jul. 22, 2014

(65) Prior Publication Data

US 2015/0027808 A1 Jan. 29, 2015

Related U.S. Application Data

(60) Provisional application No. 61/857,672, filed on Jul. 23, 2013.

(51) Int. Cl.
*B66F 17/00* (2006.01)
*B66F 11/04* (2006.01)
*A62B 35/00* (2006.01)

(52) U.S. Cl.
CPC ..... *B66F 17/006* (2013.01); *A62B 35/0025* (2013.01); *B66F 11/044* (2013.01)

(58) Field of Classification Search
CPC ..... B66F 11/04; B66F 11/044; B66F 11/046; B66F 17/006; B66F 17/00; A01D 46/20; E06C 7/003; A62B 35/0025
See application file for complete search history.

(56) References Cited

U.S. PATENT DOCUMENTS 3,809,180 A * 5/1974 Grove ..... B66F 11/046 182/129
3,817,346 A * 6/1974 Wehmeyer ..... E04G 1/22 182/14
RE28,455 E * 7/1975 Denier ..... B66F 3/22 182/148

(Continued)

FOREIGN PATENT DOCUMENTS

JP 4801374 10/2011
WO 2012109444 8/2012

OTHER PUBLICATIONS

International Search Report and Written Opinion issued in PCT International Publication No. WO2015013333 dated Nov. 24, 2014.

(Continued)

*Primary Examiner* — Katherine W Mitchell
*Assistant Examiner* — Shiref M Mekhaeil

(57) ABSTRACT

A fall arresting/prevention safety protection device for aerial lifts that delivers notifications and warnings to individuals who are subject to accidental falls or other safety hazards when performing construction or the like or when operating elevating construction machinery such as aerial lift work platforms, bucket trucks and similar type elevating work platforms. The invention further provides a load sensor that when activated transmits an emergency signal to operators, supervisors and emergency personnel. The present invention further provides a remote control to access and control movement of the aerial lift through a wireless transmission in the event the lift operator falls out of or is ejected from the bucket or work platform.

17 Claims, 20 Drawing Sheets

(56) References Cited

U.S. PATENT DOCUMENTS 3,937,340 A * 2/1976 Grove ..... B66F 11/046 182/2.11
4,456,093 A * 6/1984 Finley ..... B66F 17/006 182/18
4,602,462 A * 7/1986 Anderson ..... B66F 11/044 182/2.9
4,660,730 A * 4/1987 Holmes ..... B66F 11/044 137/596.18
4,923,037 A * 5/1990 Stephenson ..... A62B 35/04 188/188
5,268,591 A * 12/1993 Fujimoto ..... H02G 1/02 182/2.11
5,379,468 A * 1/1995 Cassidy ..... A61G 5/045 280/304.1
5,549,176 A * 8/1996 Hawkins ..... E01D 21/00 182/150
5,762,282 A * 6/1998 Wolner ..... B66D 1/7415 182/73
6,147,601 A * 11/2000 Sandelman ..... F24F 11/0086 340/12.53
6,181,095 B1 1/2001 Telmet
6,265,983 B1 * 7/2001 Baillargeon ..... A62B 35/0037 340/673
6,272,413 B1 * 8/2001 Takahashi ..... B66F 17/006 182/115
6,297,744 B1 * 10/2001 Baillargeon ..... B66F 17/006 182/14
6,330,931 B1 12/2001 Baillargeon et al.
6,679,284 B1 * 1/2004 Raymond ..... E04G 21/04 137/351
6,894,621 B2 5/2005 Shaw
7,182,174 B2 * 2/2007 Parrini ..... B66B 5/022 182/18
7,275,710 B2 * 10/2007 VanDruff ..... B64D 25/06 182/231
7,353,817 B2 * 4/2008 Kobel ..... A62B 1/22 125/12
7,462,138 B2 * 12/2008 Shetty ..... A61H 3/008 482/51
8,027,349 B2 * 9/2011 Brown ..... G05B 19/4185 370/399
8,205,718 B2 * 6/2012 Taylor ..... A63B 69/0064 182/19
8,224,518 B2 * 7/2012 Cameron ..... B66C 13/16 701/31.5
8,239,125 B2 * 8/2012 Petrie ..... B60T 7/22 340/905
8,325,053 B2 * 12/2012 Flynt ..... G08B 19/00 182/231
8,490,746 B2 * 7/2013 Cummings ..... B66F 11/046 182/18
8,514,058 B2 * 8/2013 Cameron ..... B66F 9/0755 340/10.1
8,550,211 B2 * 10/2013 Higgins ..... B66F 11/044 182/141
8,596,416 B2 * 12/2013 Crew ..... E06C 7/12 182/103
8,881,686 B2 * 11/2014 So ..... A01K 15/021 119/712
8,887,865 B2 * 11/2014 Matharu ..... E06C 7/186 182/8
9,334,145 B2 * 5/2016 Fagan ..... B66F 7/10
2001/0030081 A1 * 10/2001 Morimoto ..... B60R 3/02 182/85
2001/0045220 A1 * 11/2001 Fara ..... B08B 15/026 134/21
2002/0144862 A1 10/2002 Engvall et al.
2003/0174064 A1 9/2003 Igarashi et al.
2004/0035636 A1 * 2/2004 Julien ..... B66F 11/042 182/69.6
2007/0080021 A1 * 4/2007 Collins ..... E06C 7/003 182/18
2008/0155564 A1 6/2008 Kosuge et al.
2009/0249712 A1 * 10/2009 Brickell ..... A62B 1/10 52/173.1
2010/0130108 A1 * 5/2010 Mann ..... E04G 23/002 451/75
2011/0103558 A1 * 5/2011 Hooten ..... A62B 35/04 379/37
2012/0217091 A1 8/2012 Baillargeon et al.
2013/0103271 A1 * 4/2013 Best ..... G06F 19/00 701/50
2013/0118839 A1 * 5/2013 Penn ..... B66B 11/06 187/262
2013/0153333 A1 * 6/2013 Richards ..... B66F 11/044 182/18
2013/0206429 A1 * 8/2013 Sullivan ..... A62C 31/28 169/46
2013/0220734 A1 * 8/2013 Guglielmo ..... G05G 9/047 182/63.1
2013/0223958 A1 * 8/2013 Cummings ..... B66F 11/042 414/10
2013/0240300 A1 * 9/2013 Fagan ..... B66F 3/46 187/210
2013/0292203 A1 11/2013 Cummings

OTHER PUBLICATIONS

International Search Report dated Dec. 3, 2012 received in International Patent Application No. PCT/US2012/024481 and published as International Publication No. 2012109444.
Written Opinion dated Aug. 13, 2013 received in International Patent Application No. PCT/US2012/024481 and published as International Publication No. 2012109444.

* cited by examiner

WARNING AND MESSAGE DELIVERY AND LOGGING SYSTEM UTILIZABLE IN A FALL ARRESTING AND PREVENTION DEVICE AND METHOD OF SAME

CROSS REFERENCE TO RELATED APPLICATIONS

This application claims the benefit of U.S. Provisional Application No. 61/857,672 filed Jul. 23, 2013 entitled Warning and Message Delivery and Logging System Utilizable in a Fall Arresting and Prevention Device and Method of Same which is hereby incorporated by reference in its entirety.

FIELD OF THE INVENTION

The disclosed invention relates generally to a fall arresting/prevention device that interfaces with an active interface monitoring and warning system that delivers specific fault condition messages to individuals who are subject to accidental falls or other safety hazards when performing construction or the like or when operating elevating construction machinery such as aerial lift work platforms, bucket trucks, order selectors, and other similar type elevating work platforms and in performing work on scaffolding and other similar type elevated or suspended work platforms. The invention further provides a load sensor that when activated transmits an emergency signal to operators, supervisors and emergency personal to provide a warning of an accidental fall or ejection from a bucket or work platform. The invention further provides a remote access control affixed to the fall arresting/prevention device to control and raise or lower the aerial lift or other elevating construction machinery in the event the lift operator falls out of or is ejected off of the work platform or the bucket.

BACKGROUND OF THE INVENTION

A remote monitoring device that is specific to the fall prevention and protection has been developed by the present inventor Baillargeon and is described in pending U.S. Patent Publication No. 20120217091. The invention discloses a monitoring system that delivers warning messages and critical information to aerial lift operators to remind and enforce safety regulations including the attachment of a safety lanyard prior to movement of a work platform or bucket of an aerial lift. Construction and aerial lift machinery apparatus present significant risks and danger not only to the operators, but to those in proximity to the machinery. To address these issues, safety devices such as lanyards or safety harness detection sensors, motion and high voltage proximity sensors and other warning devices to protect the operator have been developed.

Additional patents to Baillargeon and others include U.S. Pat. No. 6,330,931 that describes a safety lanyard detection sensor and warning device which inhibits operation of the machinery and also can deliver a visual or audible message to the operator that machinery movement is inhibited because of failure by the operator to secure a safety lanyard. Also, U.S. Pat. No. 6,297,744 discloses a warning device that delivers messages to the operator to secure their safety lanyard at an initial upward movement of the work platform and delivers messages within the area below the boom and work platform or zone of danger that the boom is moving, expressing that persons below the boom should remain out of the area as the boom descends.

In both of the Baillargeon U.S. Pat. Nos. 6,330,931 and 6,265,983, the lanyard detection sensor disclosed is located on the lift anchor point. Upward movement of the work platform is inhibited via an interlock switch unless the lanyard detection sensor detects that the lift operator has attached a safety lanyard to the lift anchor point. An issue in this approach is that the system may be defeated by leaving the safety lanyard attached to the anchor point at all times. An operator may forget or otherwise fail to secure the lanyard to themselves, and can even leave the work platform and in such a situation leave the lanyard on the anchor point allowing operation of the platform without a secure attachment of the lanyard to the body harness of the operator creating a hazardous risk to the operator. In these real life scenarios, the unprotected lift operators will be able to go up in the work platform without proper utilization of their fall protection apparatus because the sensor has detected the attachment of the lanyard to the anchor point enabling lift movement without the safety lanyard being attached to the harness worn by the lift operator.

The interface monitoring device described in pending U.S. Patent Publication No. 2012/0217091 to Baillargeon includes data logging features that track telematics data specific to the operator and aerial lift device including the time and operational steps taken after connecting the safety lanyard. This information is stored and transmitted to supervisors and others to monitor and track fault conditions and safety violations in the operation of an aerial lift device. The system further provides data and warnings on severe fault conditions, such as an overload in the bucket or an outrigger stability warning and a transmission to emergency personal that an operator may be in distress. What is not disclosed in this prior art, is a load sensor affixed to the fall arresting/prevention device that when activated transmits an emergency warning signal to emergency personal, supervisors and others that a severe fault condition involving the operator falling out of and being suspended from the bucket of the aerial lift device.

A serious complication for an operator suspended vertically within a harness is suspension trauma which may result in death for the operator. This harness-induced death may occur in a wide range of situations and in safety harnesses of various types. Operators requiring fall protection, use safety harnesses, belts, and seats that suspend the operator in a vertical upright position that if held for a period of time of roughly about five minutes can cause the legs to relax straight beneath the body which results in suspension trauma caused by orthostatic incompetence (also called orthostatic intolerance). In orthostatic incompetence the legs are immobile with the operator in an upright posture. Gravity pulls blood into the lower legs, which have a very large storage capacity and as enough blood accumulates the return blood flow to the right chamber of the heart is reduced. The heart can only pump available blood and therefore the heart's output begins to fall. The heart speeds up to maintain sufficient blood flow to the brain, but if the blood supply to the heart is restricted enough, beating faster is ineffective, and the body abruptly slows the heart. In most instances this solves the problem by causing the operator to faint, which typically results in slumping to the ground where the legs, the heart, and the brain are on the same level. Blood is now returned to the heart and the operator typically recovers quickly. In a harness, however, the operator can't fall into a horizontal posture, so the reduced heart rate causes the brain's blood supply to fall below the critical level.

For an operator that falls from a bucket or work platform and is suspended in an upright posture with legs dangling, the safety harness straps exert pressure on leg veins, compressing them and reducing blood flow back to the heart. The operator in only a short period of time may lose consciousness, which is what kills the operator with emergency personal arriving too late to revive the operator. While a fall victim can slow the onset of suspension trauma by pushing down vigorously with the legs, and attempting to position their body in a horizontal or slight leg-high position, most harness designs do not provide proper support or attachments for the operator to maneuver their body into a horizontal position and if the operator is injured, pulling their own weight to align their body horizontally may be difficult. Rescue must come rapidly to minimize the dangers of suspension trauma or preferably with the minimal amount of time available the operator must be able to take the proper steps to save themselves. The present invention has a number of features to address this issue and the safety of the operator including a remote control of the work platform or aerial lift bucket that provides for an operator to raise themselves back to the work platform or bucket, or lower themselves to the ground after a fall.

SUMMARY OF THE INVENTION

The present invention discloses a fall arresting/prevention safety protection device in the form of a smart snap and/or smart snap safety lanyard that is secured to a suspension harness for an operator or worker performing work on elevated work platforms of aerial lift machinery and equipment. In the present invention, the smart snap or smart snap safety lanyard includes an interlock controller that identifies the operator and aerial lift equipment; notifies the operator to attach the safety lanyard if the attachment of the safety lanyard to the suspension harness and to the work platform is not detected; records each attachment and detachment of the safety lanyard and each up and down movement of the aerial lift with time and dates stamps; transmits the operator and lift activity data to an interface monitoring unit as described in U.S. Patent Publication No. 2012/0217091 to Baillargeon and/or to an external server, telematics system or other digital device. The identification of the operator includes information about the operator's training records, and using an installed software application on the storage device of the smart snap, the operational controls of the work platform or aerial lift may be locked out for operators that have not been properly trained on the equipment. The present invention may further include one or more load sensors that transmits a warning using the smart snap to emergency personnel in the event an operator has fallen or been ejected from an elevated work platform or aerial lift bucket. The notification may also be transmitted to the interface monitoring unit and/or to an external server, telematics system or other digital device.

The load sensor activates if a prescribed load limit is exceeded such as by the increased load of the operator's weight from being suspended from the safety harness due to a fall or ejection from the work platform or bucket. Activation of the load sensor triggers the immediate transmission of a warning to emergency personal providing the location and identification of the work platform equipment or aerial lift vehicle and operator, a notification that a fall from height has occurred, and other information to summon help and assist the suspended operator. This feature provides for assistance in hazardous situations to be immediately requested and in this way an injured operator can receive medical attention as quickly as possible and the risk of suspension trauma may be greatly reduced.

The present invention further provides a remote control to access the operational controls of the aerial lift equipment. The remote control may be accessible on the safety lanyard or harness to provide for the operator to maneuver the bucket or work platform to the ground or to an acceptable position for the operator to avoid injuries and climb back into the bucket or onto the work platform and resume operation of the aerial lift. In further embodiments, the remote control may be through a software application accessible through a digital device to control and move the work platform of the aerial lift from a remote location.

An object of the present invention is to provide communications and warnings to an operator to reinforce safety protocols, issue emergency warnings in the event of a fall by an operator has occurred, and provide the identification and other information about the operator to assist emergency personnel in treatment of the operator. This information is to be stored in the smart snap and/or interface monitoring unit and is transmitted via wireless communications.

The present invention is related to a safety protection device for aerial lift equipment, comprising a remote control to control the movement of an aerial lift; and wherein in the event that an operator of an aerial lift falls from a work platform the aerial lift is controlled using the remote control to move the work platform to a safe location for the operator. The safety protection device for aerial lift equipment further comprises a safety harness for attachment of the remote control. The remote control may alternatively be a software application installed on a microprocessor of a digital device providing for the remote control software application to be accessed from a location remote from the aerial lift equipment. The safety protection device for aerial lift equipment may further comprise a snap hook for a safety lanyard, the snap hook comprising; an interlock controller and a detection sensor and the detection sensor may transmit a signal to the interlock controller when the snap hook is attached to an anchor and when the snap hook is detached from the anchor. The safety protection device for aerial lift equipment may further comprise a load sensor.

The present invention is further related to a safety protection device for aerial lift equipment, comprising a snap hook for a safety lanyard, the snap hook comprising an interlock controller and a detection sensor and the detection sensor transmits a signal to the interlock controller when the snap hook is attached to an anchor; and the detection sensor transmits a signal to the interlock controller when the snap hook is detached from the anchor. The interlock controller of the safety protection device for aerial lift equipment may transmit at least one warning signal if the attachment of the snap hook is not detected when movement of the aerial lift equipment is detected. The safety protection device for aerial lift equipment may further comprise a load sensor that transmits at least one warning signal when activated. The interlock controller of the safety protection device for aerial lift equipment may further comprise a storage device and a communications interface and every detection of the attachment and every detection of the detachment of the snap hook to the anchor and all issued warnings may be stored in the storage device and transmitted using the communications interface of the interlock controller. The interlock controller of the safety protection device for aerial lift equipment may further comprise a RFID reader. The communications interface of the interlock controller may further comprise a microprocessor to read and write information to and from an autoidentification device. The interlock controller may further comprise a software application stored within the storage device and accessible from the microprocessor of the communications interface; and wherein the software application comprises an evaluation of training of the operator from data received from an autoidentification device, and a signal is transmitted to lock out controls of the aerial lift based on the evaluation of training of the operator. The safety protection device for aerial lift equipment may further have the load sensor installed to the snap hook and may transmit the warning signal to the interlock controller to be stored and remotely transmitted using the communications interface.

The present invention is further related to a safety protection device for aerial lift equipment, comprising a load sensor and wherein the load sensor transmits a warning signal in the event an operator of an aerial lift falls from a work platform. The load sensor may be installed on a smart snap or snap hook attached to a safety lanyard. Alternatively, the load sensor may be installed on a self-retractable reel. The load sensor of the safety protection device for aerial lift equipment may transmit the warning signal to emergency personnel and the warning signal may comprise the location, identification, and information about the operator.

These and other features, advantages and improvements according to this invention will be better understood by reference to the following detailed description and accompanying drawings.

BRIEF DESCRIPTION OF THE DRAWINGS

Several embodiments of the present invention will now be described by way of example only, with reference to the accompanying drawings in which.

DETAILED DESCRIPTION OF THE INVENTION

Figure 1:
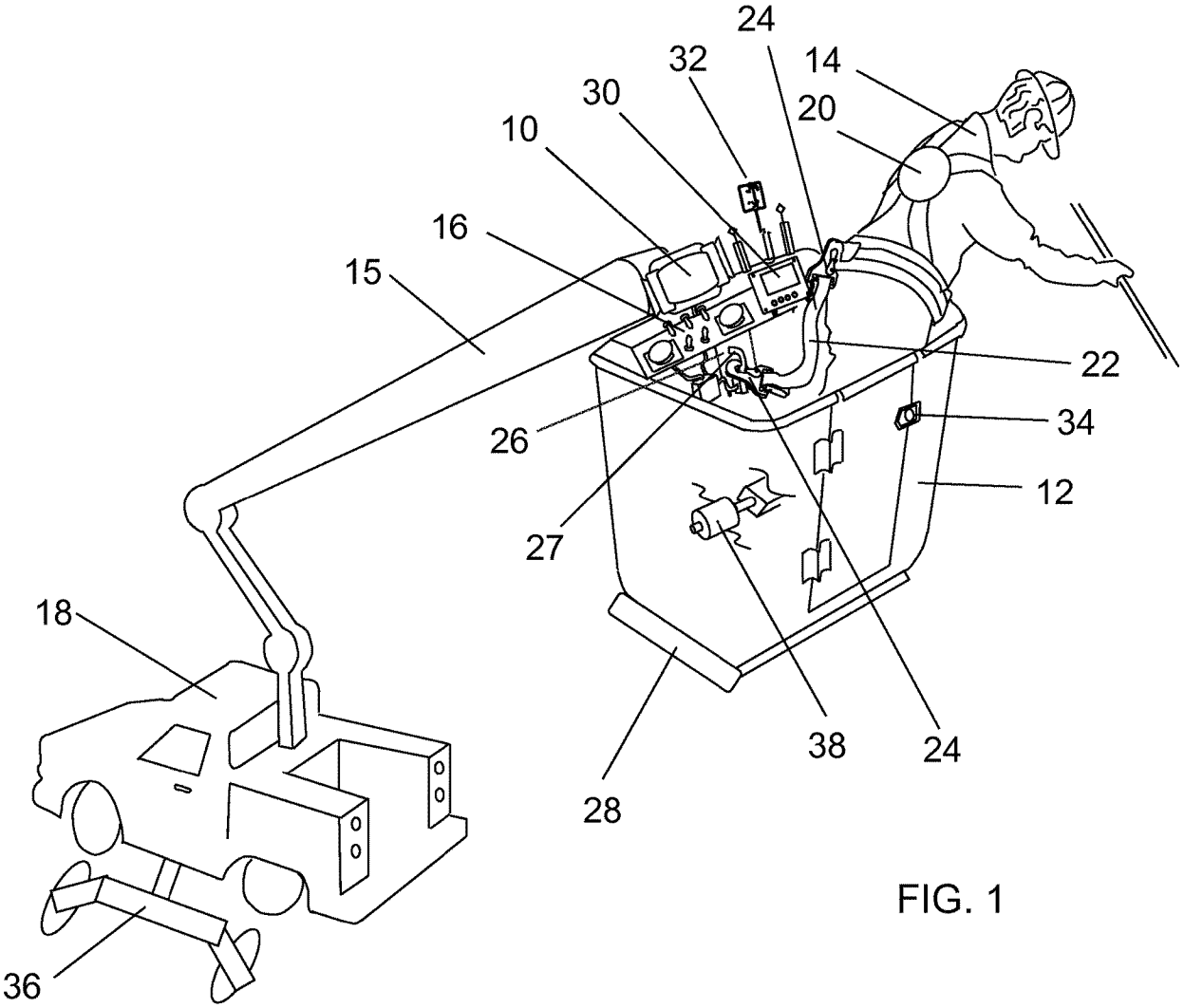
FIG. 1 illustrates an embodiment of an aerial lift bucket with a vehicle.

An interface monitoring unit 10 as shown in FIG. 1 and described in U.S. Patent Publication No. 20120217091 provides a single command point for the distribution of alerts and fault condition messages to an aerial lift operator, and provides instructive reinforcement to create operator compliance of safety regulations and procedures. The interface monitoring unit 10 is in communication with several safety warning devices through wired or wireless connections and to a data server to assist the operator in safely operating the aerial lift by monitoring and detecting fault conditions and providing verbal reminders and commands to notify the operator, supervisor or others of the operational status within the work environment. The interface monitoring unit 10 further records and collects all operational data through an intranet or internet connection to a data server and maintains logs of all actions of the operator with respect to operation of the aerial lift. Vehicle telematics and tracking including the location, movements, status and behavior of a vehicle or fleet of vehicles is achieved through a combination of a GPS (GNSS) receiver and an electronic device (usually comprising a GSM GPRS modem or SMS sender) installed in each vehicle, communicating with the user (dispatching, emergency or co-coordinating unit) and application or web-based software. The data are turned into information by management reporting tools in conjunction with a visual display on computerized mapping software.

The data server may be housed within the vehicle or aerial lift support machinery and may be connected locally to the interface monitoring unit 10 or alternatively may be through a wireless connection to a secure intranet or internet server. The data server in conjunction with the interface monitoring unit 10 may send warning messages and data as alerts to one or more email addresses, telephones, tablet, iPods, iPads, or PDAs. The interface monitoring unit 10 may provide organized and categorized data and metadata to the data server based on signals transmitted to and from the vehicle motion controls and/or the equipment condition detectors. Data transmission from the interface monitoring unit may establish predetermined categories and organizational hierarchy through the use of data fields and metadata to efficiently store and access relational data within one or more of the data server databases. The monitoring unit 10 may further interface with a telematics system such as for example a vehicle monitoring system that provides speed and diagnostic information such as tire pressure of the vehicle or other information or a global positioning system (GPS) that provides location of the vehicle in the event of a critical warning and/or provides location information with logged data as described in further detail below A conventional aerial lift boom application may include a truck 18 or other support system which has an aerial lift boom 15 that supports an aerial lift work platform or bucket 12 in which an operator 14 works. A control panel 16 has buttons and switches to operate the aerial lift work platform in an upward, downward, retracted or extended motion, with safety switches to immediately shut down power as required in an emergency. The aerial lift operator 14 is typically restrained to the aerial lift work platform or bucket 12 via a body harness 20 and a safety lanyard 22. The safety lanyard 22 is connected at each end to fasteners such as snap hooks 24 and extends between the body harness 20 and an attachment point, such as a support anchor point 26 on the boom 15 or work platform 12. As noted above a failure to properly connect the safety lanyard 22 to the support anchor point 26 may result in injury or death if an operator falls off of the work platform or out of the bucket 12 of an aerial lift.

The interface monitoring unit 10 may connect with a variety of safety devices which may include an overload sensor 28 or load fault warning that detects excessive weight or an abrupt change in weight on the work platform or bucket 12; a high voltage proximity warning 30 that detects high voltage at a distance of for example approximately 3 meters (10 feet) from the aerial lift work platform or bucket 12; an environmental condition detector such as a wind speed indicator 32 that warns of high wind conditions; a door lock detector 34 and an outrigger stability warning 36 that measures the vertical grade of the parking area of the vehicle 18 or aerial lift support machinery and sends an alert if the slope is too steep and there is a risk of tilting or instability.

The present invention is an improved snap fastener or snap hook and safety lanyard referred to herein as a smart snap 40 and smart snap lanyard 42 that communicates with the interface monitoring unit 10, or directly to a server of a telematics system, or other digital device. Telematics systems are commonly in use by many industries to track and locate vehicles and equipment. The smart snap 40 houses an interlock controller 44 that performs a number of tasks to assist an operator in an emergency as well as in the adherence to safety procedures and requirements. In an embodiment of the interlock controller 44 the detection of the attachment or detachment of the smart snap 40 to an anchor point 26 is received and stored. The interlock controller 44 further issues verbal, audible and visual warnings if the attachment is not detected when the aerial lift equipment is in operation by detecting all up, down, retracted and extended movements of the aerial lift platform 12. The interlock controller 44 stores and transmits the detection of attachment and detachment, warnings issued for attachment, and operational movements of the aerial lift equipment. This data is transmitted to the interface monitoring unit 10, or directly to a computer, laptop, tablet, smartphone, iPod, iPad, or other digital device and/or to a server of a telematics system. The transmission includes the identification of the operator and the aerial lift unit or worker on a work platform, the location and the time stamp with date of the attachment and detachment of the smart snap hook 46 to an anchor point 26 and all other operational data with respect to movement of the aerial lift work platform 12. From accumulating this information a data log can be compiled to verify proper attachment and detachment of the snap hook and adherence to other safety requirements during operation of the aerial lift or the performance of work on a work platform, such as an order picker in a warehouse or a construction worker on scaffolding.

Figure 2:
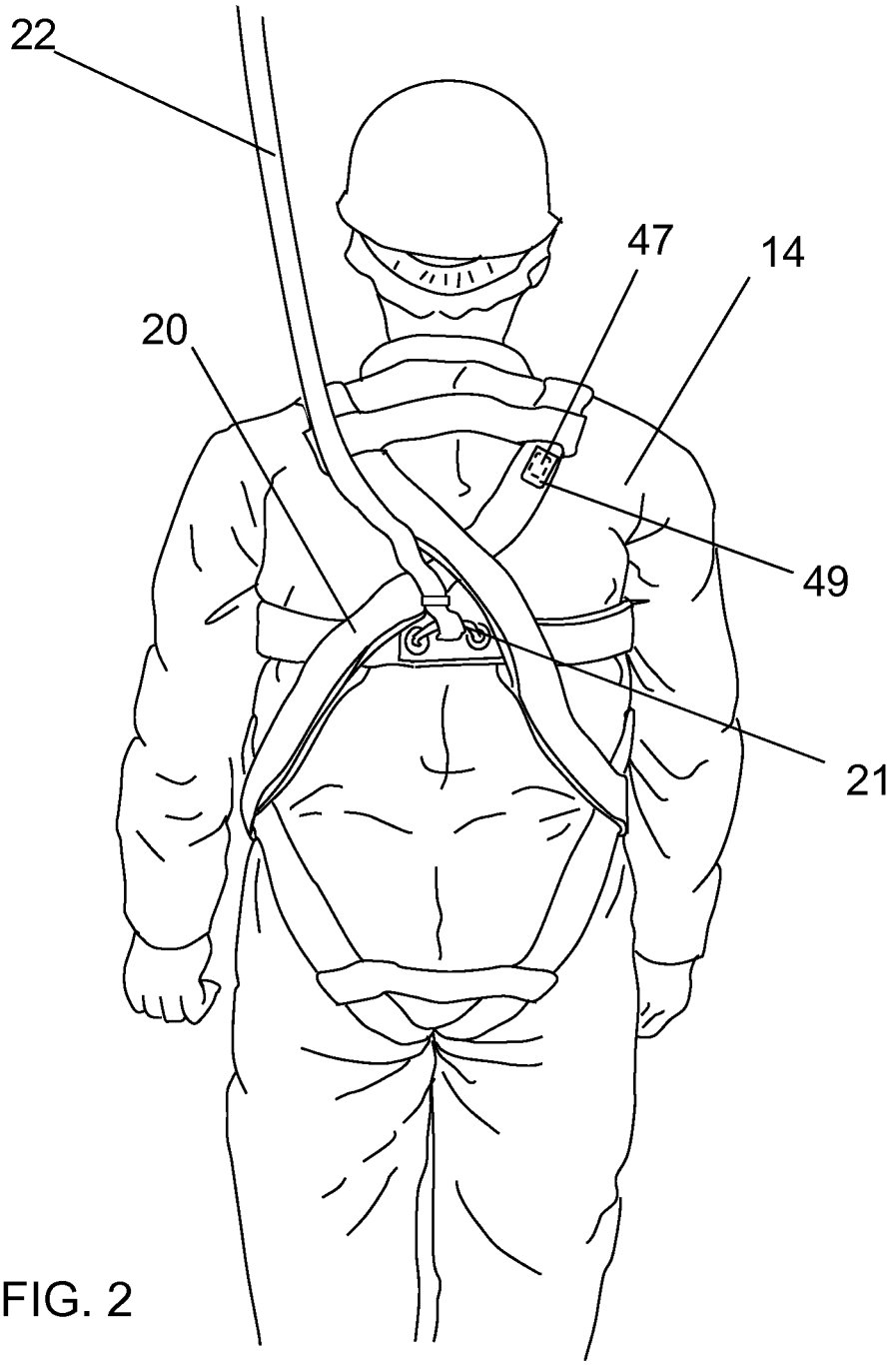
FIG. 2 illustrates an embodiment of a safety harness on an operator with the connection of a safety lanyard.
Figure 3:
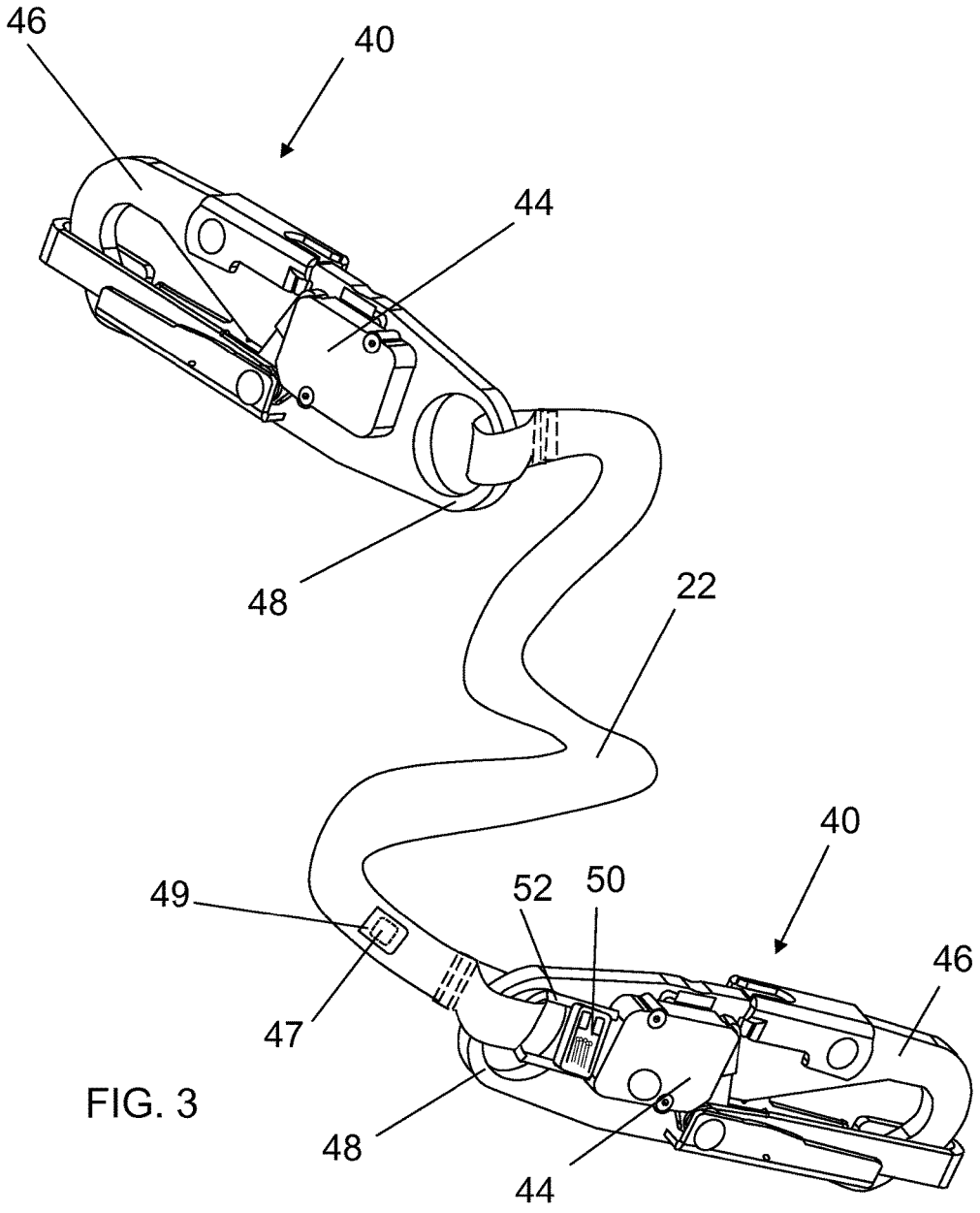
FIG. 3 illustrates an embodiment of a safety lanyard having a smart snap of the present invention attached to each end.
Figure 4:
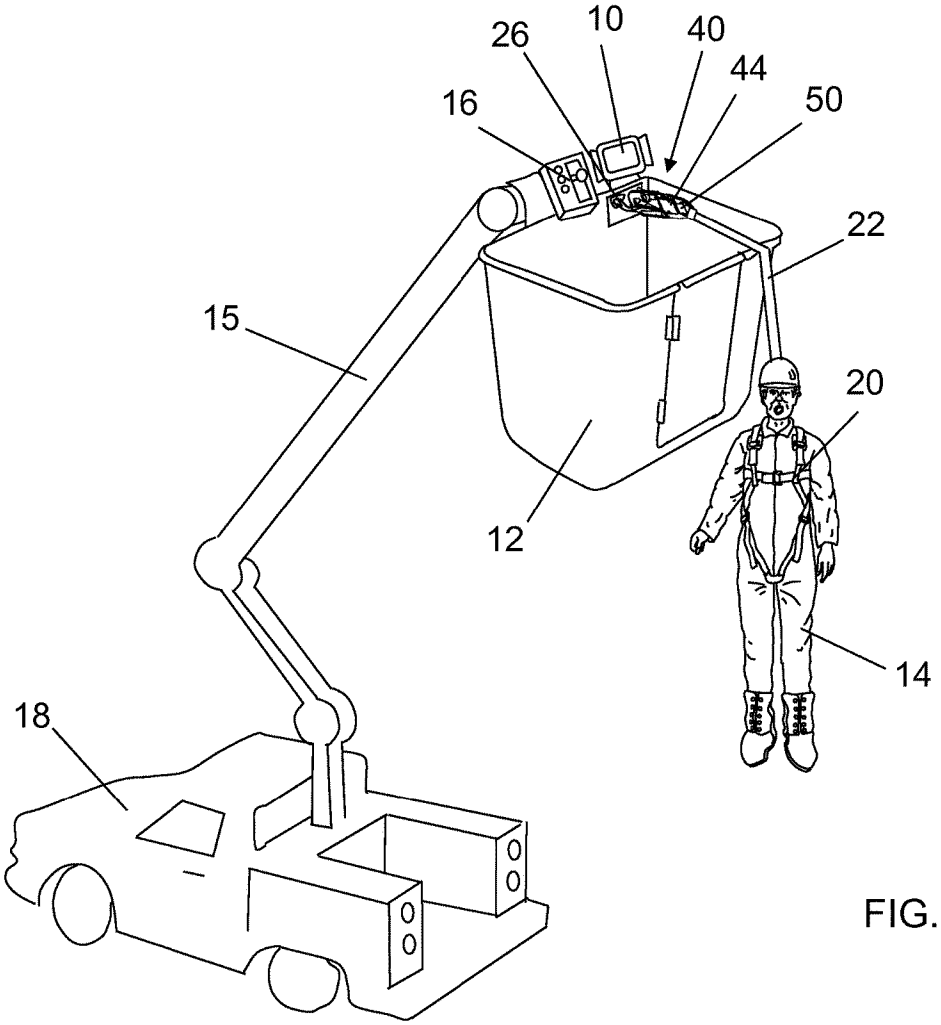
FIG. 4 illustrates an embodiment of an operator dangling from the aerial lift bucket.

In an embodiment, a first end of a lanyard 22 is permanently secured to a D-ring 21 or other attachment point on the body harness 20, as shown in FIG. 2, and a smart snap 40 is permanently secured to the other end of the safety lanyard 22 by looping the fabric end of the lanyard 22 over the lanyard ring 48 and sewing or otherwise securing the lanyard 22 to itself. Alternatively, a smart snap 40 may be permanently secured to each end of the safety lanyard 22, as shown in FIG. 3. In addition to the interlock controller 44, the smart snap 40 may further have a load sensor 50 to detect when an excessive load is applied to the lanyard, such as from an operator 14 falling out of the bucket and dangling from the lanyard as shown in FIG. 4. The load sensor 50 is provided with a load bracket 52 that is attached to the lanyard 22, by threading the lanyard 22 both through the opening of the load bracket 52 and the lanyard ring 48 and then securing the lanyard 22 to itself so that the smart snap 40 with load sensor 50 is permanently attached to the lanyard 22. The load sensor 52 may alternatively be affixed with a load bracket to the D-ring of the anchor point 26.

Figure 5:
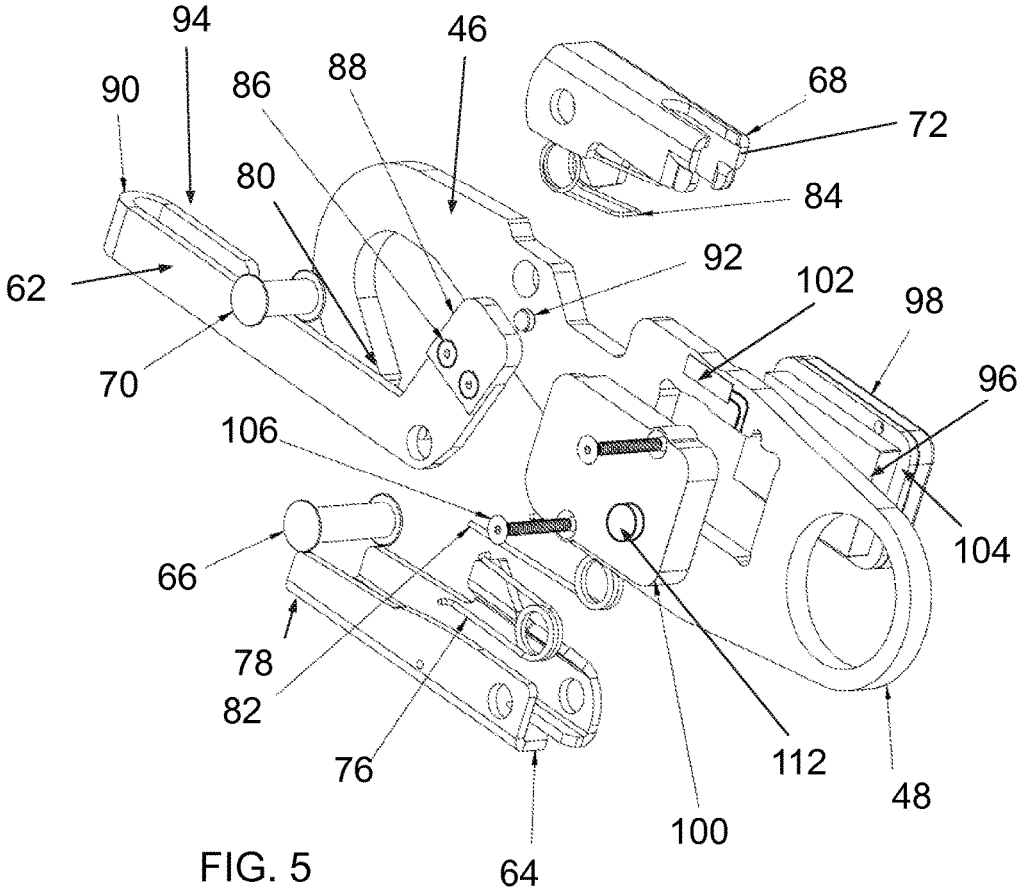
FIG. 5 illustrates an exploded view of an embodiment of the smart snap of the present invention.

As shown in FIG. 5, the smart snap 40 is constructed using the smart snap hook 46 as a base for the attachment of the interlock controller 44 and detection mechanism. In an embodiment, the detection mechanism comprises a gate switch 62 that rotates together with a gate hook 64 about a pivot point 66 as the smart snap hook 46 is pushed or pulled over the anchor block D-ring 27 or the harness D-ring 21 or other attachment point. The gate hook 64 and the gate switch 62 each have a torsional spring. The gate hook torsional spring 76 maintains torsional force against the gate hook 64 to push the gate hook 64 in a position with the tip or base 78 of the gate hook 64 pressed against the end 80 of the snap hook 46 to maintain the smart snap 40 in a closed position. Similarly, the gate switch torsional spring 82 applies force to the gate switch 62 to maintain contact with a D-ring or other external attachment bar or maintain the gate switch 62 in a closed position against the gate hook 64, if no bar is within the smart snap 40. A release gate or hook release 68 has a third torsional spring 84 that maintains the hook release 68 in a closed position in contact with the snap hook 46. By pressing down on the hook release 68, an extension arm 72 of the hook release 68 contacts and presses against an extension member 88 of the gate switch 62 providing for an operator to open the gate switch 62 and release the smart snap 40 from the D-ring. As the gate switch 62 closes, the hook release 68 is forced back by the release spring 84 removing the extension arm 72 from pushing the extension member 88 of the gate switch 62.

In a fully closed position, the gate switch 62 is forced by spring tension against the hook gate 64. In a partially closed position, the gate switch 62 is forced by spring tension against a D-ring or other attachment bar. While partially closed the gate switch 62 partially blocks or otherwise activates a magnetic, optical, induction, Hall Effect, radio frequency, mechanical or other variety of sensor or switch. In an embodiment the interlock controller has a first interlock detection sensor 86 affixed to the extension member 88 that extends up from the base frame 90 of the gate switch 62. A second interlock detection sensor 92 is affixed to the snap hook 46. The base frame 90 of the gate switch 62 may be formed as an overlapped extension 94 that loops over and around the snap hook 46 to align and hold the gate switch 62 in contact or nearly in contact with the snap hook 46 so that as the gate switch 62 opens it slides and aligns the first detection sensor 86 on the extension member 88 with the second detection sensor 92 on the snap hook 46. The alignment of the sensors is maintained only if the gate switch 62 is partially open and held by torsional spring 82 against the D-ring.

Figure 6A:
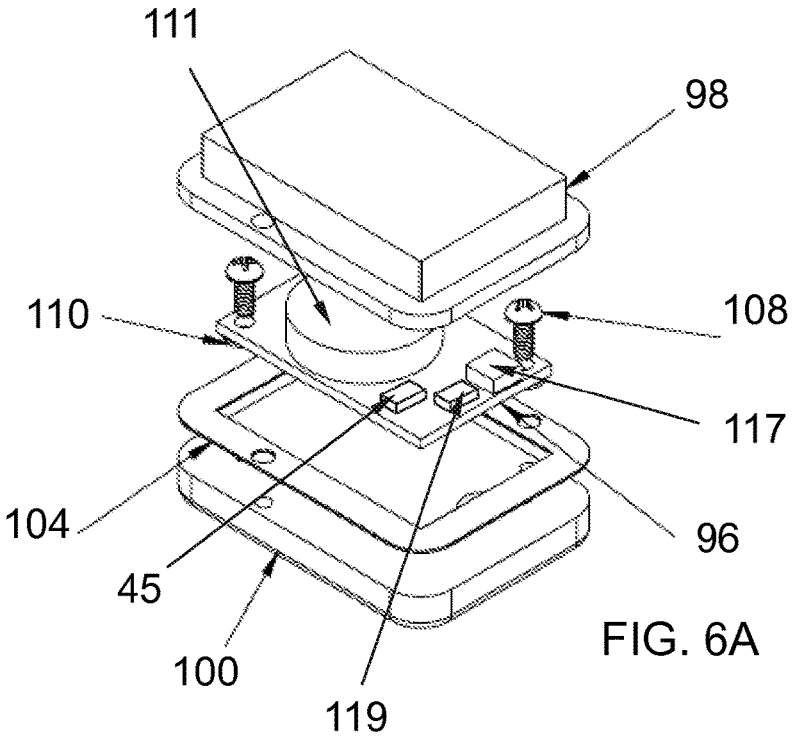
FIG. 6A illustrates an exploded view of an embodiment of an interlock controller of the smart snap of the present invention.
Figure 6B:
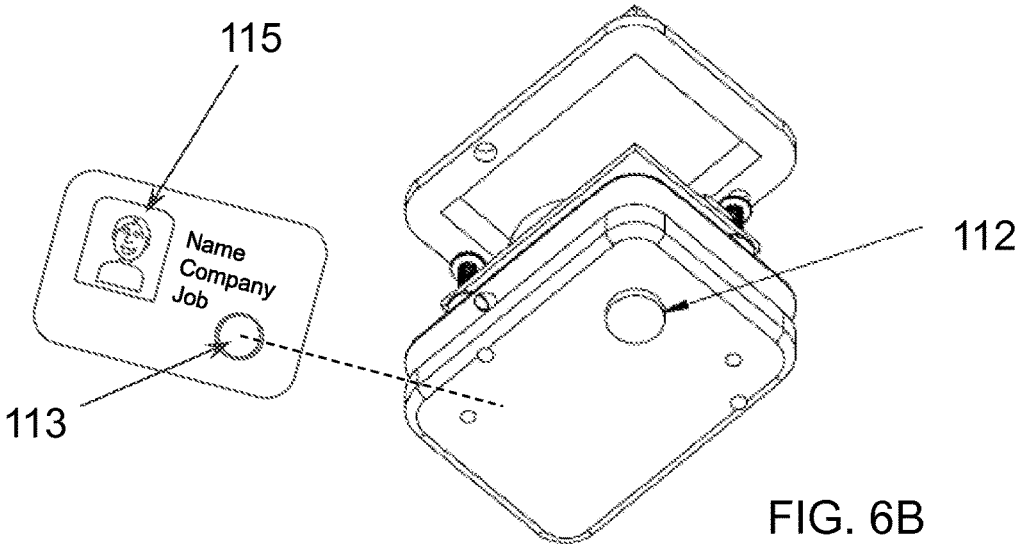
FIG. 6B illustrates an exploded view of an embodiment of the interlock controller of the smart snap of the present invention and an identification badge with an autoidentification device.

The interlock detection sensors may for example be Hall Effect sensors that will trigger or send an output signal when a magnet is within close proximity to the sensor device. The Hall Effect sensor may be the first detection sensor 86 and be affixed to the end of the extension member 88 on the gate switch 62 and a magnet may be the second detection sensor 92 affixed to the snap hook 46. As the gate switch 62 is partially opened and held against the D-ring, the Hall Effect sensor of the first detection sensor 86 changes its output voltage by the close proximity or alignment of the magnet of the second detection sensor 92. The change in voltage from the Hall Effect sensor may initiate a timer on a printed circuit board 96 mounted within the housing 98 of the interlock controller 44 to track the amount of time from the opening and attachment of the smart snap 40 to the D-ring to the time of detachment of the smart snap 40 from the D-ring. The housing 98 with the printed circuit board 96 may attach or be inserted through an opening in the snap hook 46 to mate with a housing cover 100. A ground 102 may be wired from the printed circuit board 96 to the snap hook 46. As shown in FIGS. 6A and 6B, a gasket 104 to environmentally seal the housing may also be used. One or more screws 106, adhesive, or other attachment fixtures connect the housing 98 and cover 100 together through the snap hook 46 with separate screws 108 and washers 110 affixing the printed circuit board 96 to the housing 100.

The attachment of the smart snap 40, the time of attachment and detachment, operator identification and information, the identification of the aerial lift or work platform and other information may further be recorded, logged and stored within an internal data storage unit 111 of the interlock controller 44 and/or be transmitted using wired or wireless communication to an external telematics server or other computer or digital device. The identification of the operator and other information specific to the operator may be stored in an autoidentification semi-conductor memory device 113 such as the product offered from Maxim Integrated Products, Inc. referred to as an iButton that provides for storage and transmission of data in a small, durable container that can withstand harsh environments. The autoidentification memory device 113 may be integrated into the interlock controller 44, into the safety lanyard, or alternatively each operator or worker carries their individual autoidentification device 113 on their identification badge 115. The interlock controller 44 includes a communications interface 117 microprocessor to read and write information to and from the autoidentification device 113 and a wireless interface 119 to transmit and receive data from the device 113 through a Wi-Fi, Cellular, Bluetooth or other wireless communication protocol. The communications interface 117 may have a speaker or a headphone jack. The smart snap 40 may be activated using near field communication (NFC) where the user of the safety lanyard taps or brings their autoidentification device 113 close to the smart snap 40 and data from the device 113 is read by the communications interface 117 of the interlock controller 44.

The interlock controller 44 may further include a radio frequency (RF) reader 45 or other transmission signal receiver/transmitter to access information from radio frequency identification (RFID) tags 47 that are affixed to objects, such as inventory or equipment to allow a manufacturer or large company to audit inventory and track the age and maintenance of equipment. In an embodiment, an RFID tag 47 may be on the smart snap 40 or sewn in a pocket 49 to a harness 20 and sewn to a lanyard 22. The harness 20 and lanyard 22 can then be assigned to a worker and the RFID tag 47 can store the identification of the harness 20, the lanyard 22, and the operator who is associated with this equipment. Using the RFID reader 45 of the interlock controller 44 operational information, activity of the operator, and other information such as the location of items moved using the aerial lift equipment may be transmitted to the interface monitoring unit 10 to track inventory, and operational activity of a worker and equipment. The interlock controller 44 may further communicate directly with a telematics or materials management system to track inventory and location information particularly important in high security areas where the location of workers and equipment is critical. Currently hand scanners are the most common device used to track the information from the RFID tags 47, requiring an extra step by a worker to scan an item that has been moved and loaded on the aerial lift, or to identify the location of a piece of equipment, creating added costs in time to employers and manufacturers. The present invention provides a hands free method of tracking data using the interlock controller 44 of the smart snap 40 with the added benefit of reinforcing safety protocols and reducing injuries. In further embodiments, the RFID reader 45 may be integrated with the interface monitoring unit 10 to track equipment movement and usage. The RFID reader 45 may also activate when close to or in contact with the RFID reader 45.

Activation by the autoidentification device 113 and/or by the RFID tag 47 may trigger a transmission to and from the local data storage device 111 and/or to and from an external data storage device in order to supplement the data and store further data on the autoidentification device 113 or the RFID tag 47. The data may include the identification of the operator and other specific information that may be related to the operator such as the level of experience of the operator, the amount of time recorded in use of the particular aerial lift equipment being used, the training certificates received for specific aerial lift equipment and amount of time spent in training on specific aerial lift equipment and on other types of equipment by the operator. A software application may be installed locally within the storage device 111 and be accessed using the microprocessor of the communications interface 117 of the interlock controller 44 on the smart snap 40. The software application may evaluate the stored information about the operator and deny access to any operator not experienced on the equipment by transmitting a signal to the interface monitoring unit 10 or controller of the equipment to lock down of the controls. Other verbal alarms and communication transmissions may alert authority personal to unauthorized use of the equipment by unqualified workers.

During use of the smart snap 40, data may be transmitted to the autoidentification device 113 and/or RFID tag 47 to update information such as the amount of time the operator is using the aerial lift or work platform equipment. Training modes, subordinate access, and other access parameters may be set to update and communicate to more than one operator using the equipment at one time. Information stored within the autoidentification device or RFID tag 47, the operational activity and data log of the aerial lift or work platform equipment including issued warnings and other data stored within the interlock controller 44 may be accessed using a software application or app installed within a storage device and accessed using a microprocessor of the interface monitoring unit 10, a tablet, a smartphone or other mobile digital device in communication with the interlock controller 44. The software application on the external device may evaluate training criteria required for the operator of the particular equipment and transmit an instruction to the operational controls of the equipment to deny access. The smart snap 40 may further have a signaling button 112 that contacts emergency personal when activated by the operator. By selecting the button 112 the interlock controller 44 of the smart snap 40 transmits the identification and location of the operator and other information and summons help to the operator in an emergency.

Figure 7A:
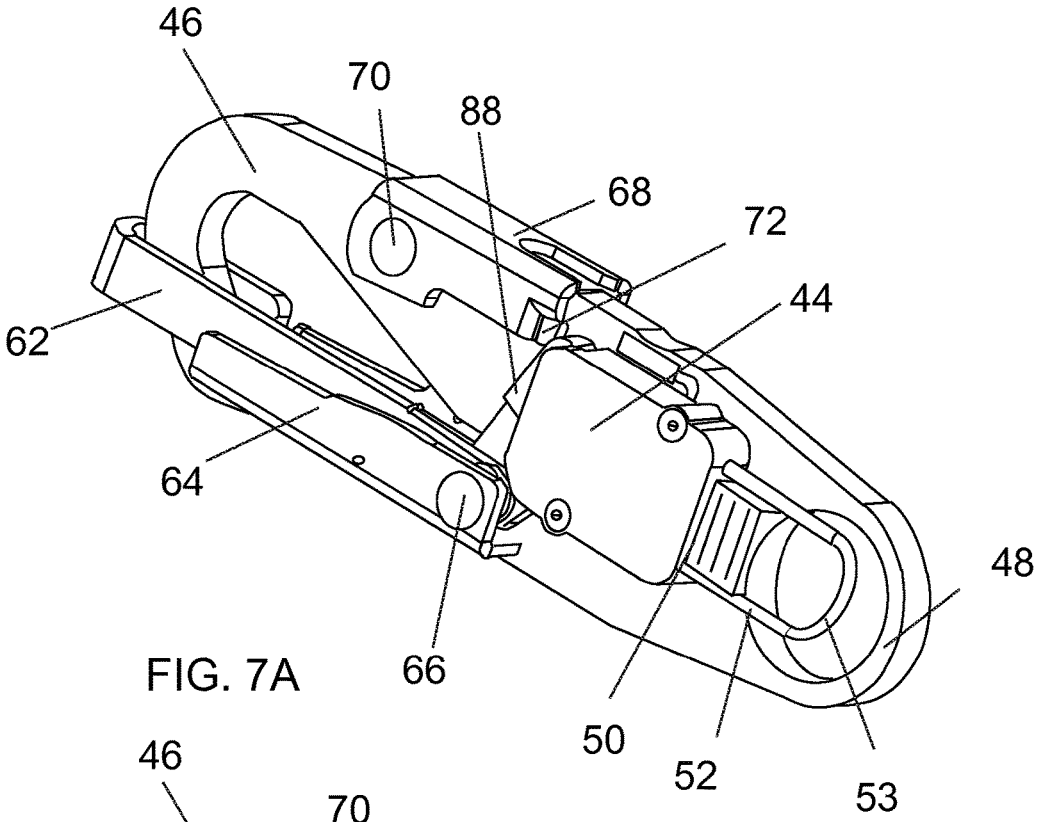
FIGS. 7A and 7B illustrate perspective views of an embodiment of the smart snap of the present invention with a load sensor.
Figure 7B:
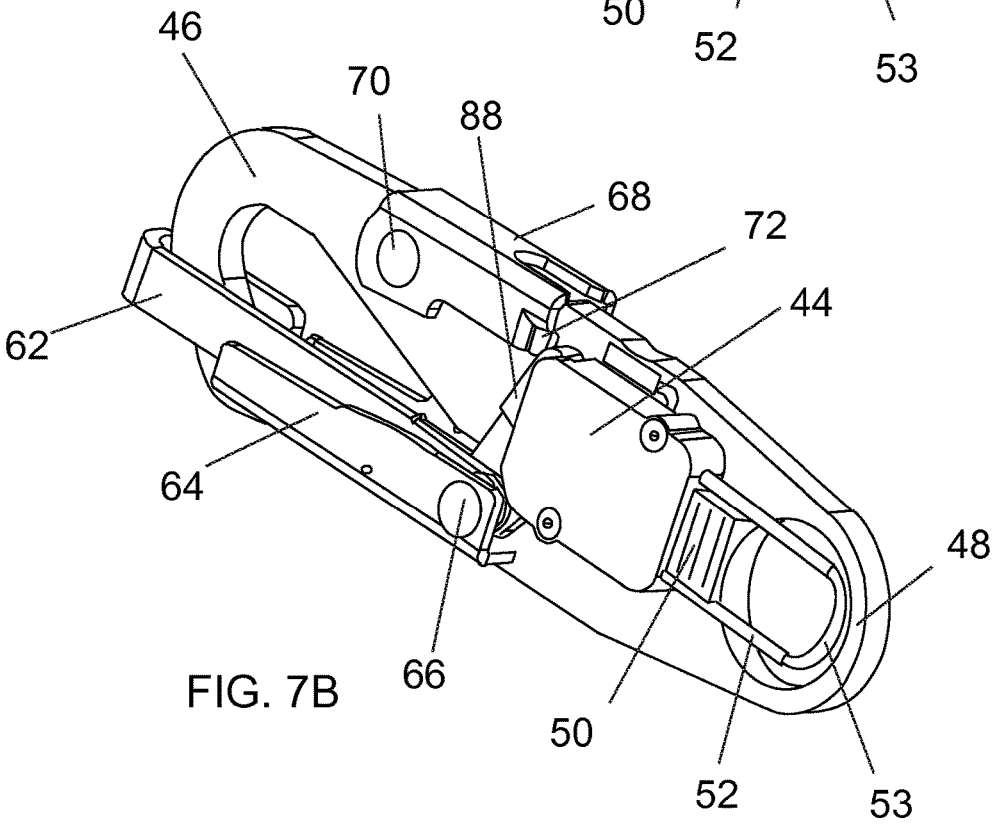
Figure 8:
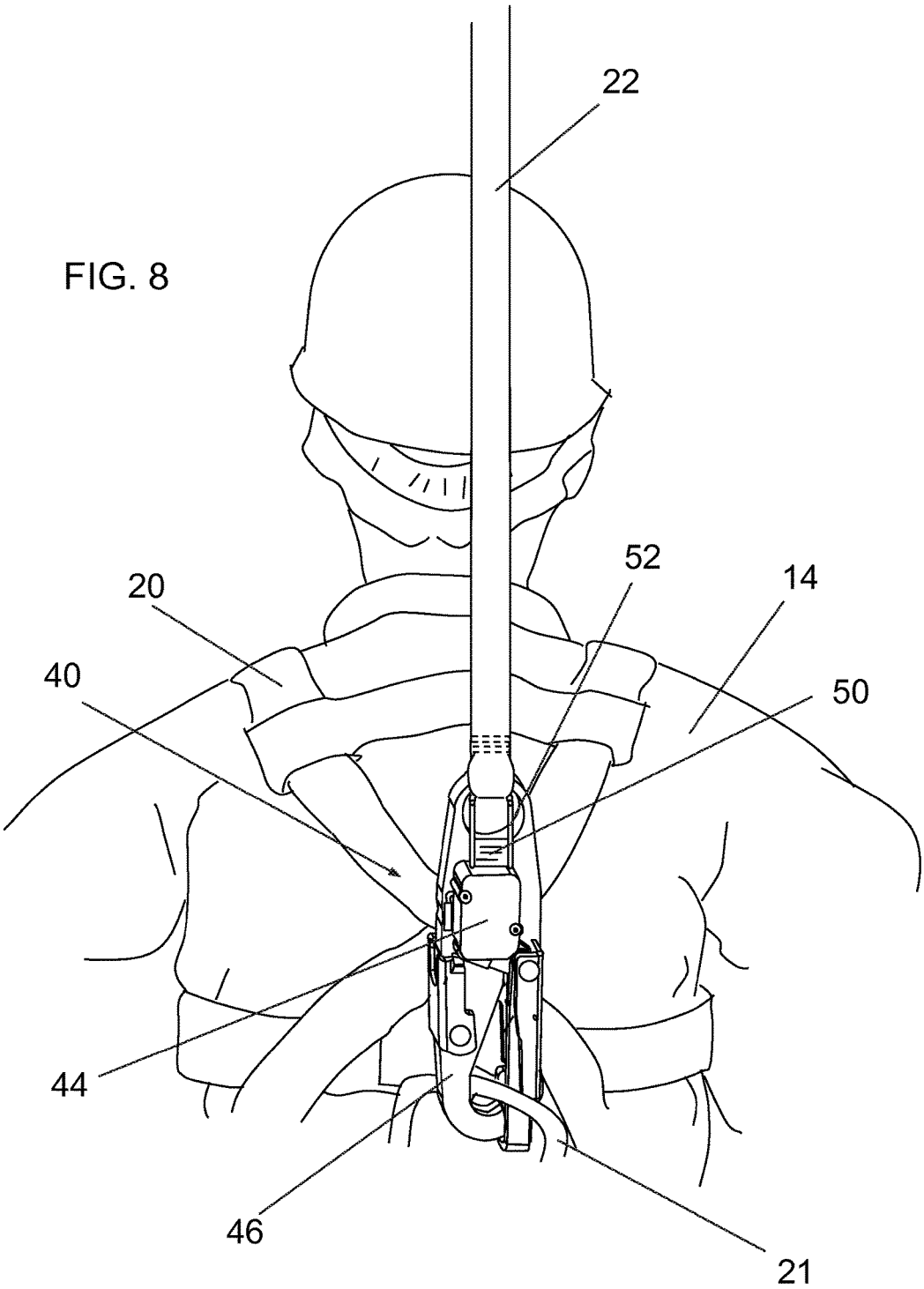
FIG. 8 illustrates an embodiment of an actuated load sensor on a smart snap of the present invention and attached to the safety harness of an operator dangling from a work platform or aerial lift bucket.

In addition to communication with the autoidentification device 113 and the emergency signal button 112, the smart snap 40 may have a load sensor 50 that activates when a load on the lanyard 22 exceeds a prescribed force, signaling that the operator 14 has fallen out or been ejected from and is left dangling from the work platform or bucket as shown in FIG. 8. In FIG. 7A, the load sensor 50 is shown in a non-actuated position with its load bracket 52 securely attached to the snap hook base 46 and the U-bracket 53 rigidly set at a distance from the lanyard ring 48. A space is left between the U-bracket 53 and lanyard ring 48 and the U-bracket 53 adequately supports and attaches the safety lanyard 22 to the smart snap 40. The load sensor 50 includes a resistive or capacitive strain gauge load cell that is well suited for harsh environments and temperature fluctuations to prevent actuation of the load sensor 50 inadvertently. The load sensor 50 cannot be actuated through normal operation such as by movement of the operator 14 within the safety harness 20 or in up, down, retracted or extended movements of the aerial lift. The load sensor 50 is only actuated by exceeding a prescribed force comparable to a percentage of force exerted on the safety harness 20 and lanyard 22 from the operator 14 falling from the bucket 12.

When actuated, the load sensor 50 immediately transmits a signal to the smart snap 40 that then transmits an emergency signal to local emergency personal within the vicinity of the aerial lift such as a 911 call and to supervisors and other company personal, in a similar manner to the operator pressing the emergency button 112. The transmission includes that the accident is a fall from a height, the height at which the person is dangling, and all other pertinent telematics information about the truck 18, the operator 14, the aerial lift or work platform equipment, and the location. The transmission may include other important information for emergency personal such as medical or physical information about the operator environmental conditions and other critical information that may assist in the rescue of the operator 14. This information is accessed locally from the smart snap data logs, the autoidentification device 113, the RFID tag 45 and/or through the interface monitoring unit 10 to help assist particularly in the event the operator 14 is unconscious due to an accident during the fall, or due to suspension trauma. The immediate transmission to both local and company personal may greatly help to reduce death caused by suspension trauma, where emergency personal may be able to arrive in minutes and safely remove the operator 14 and administer medical attention.

Figure 9:
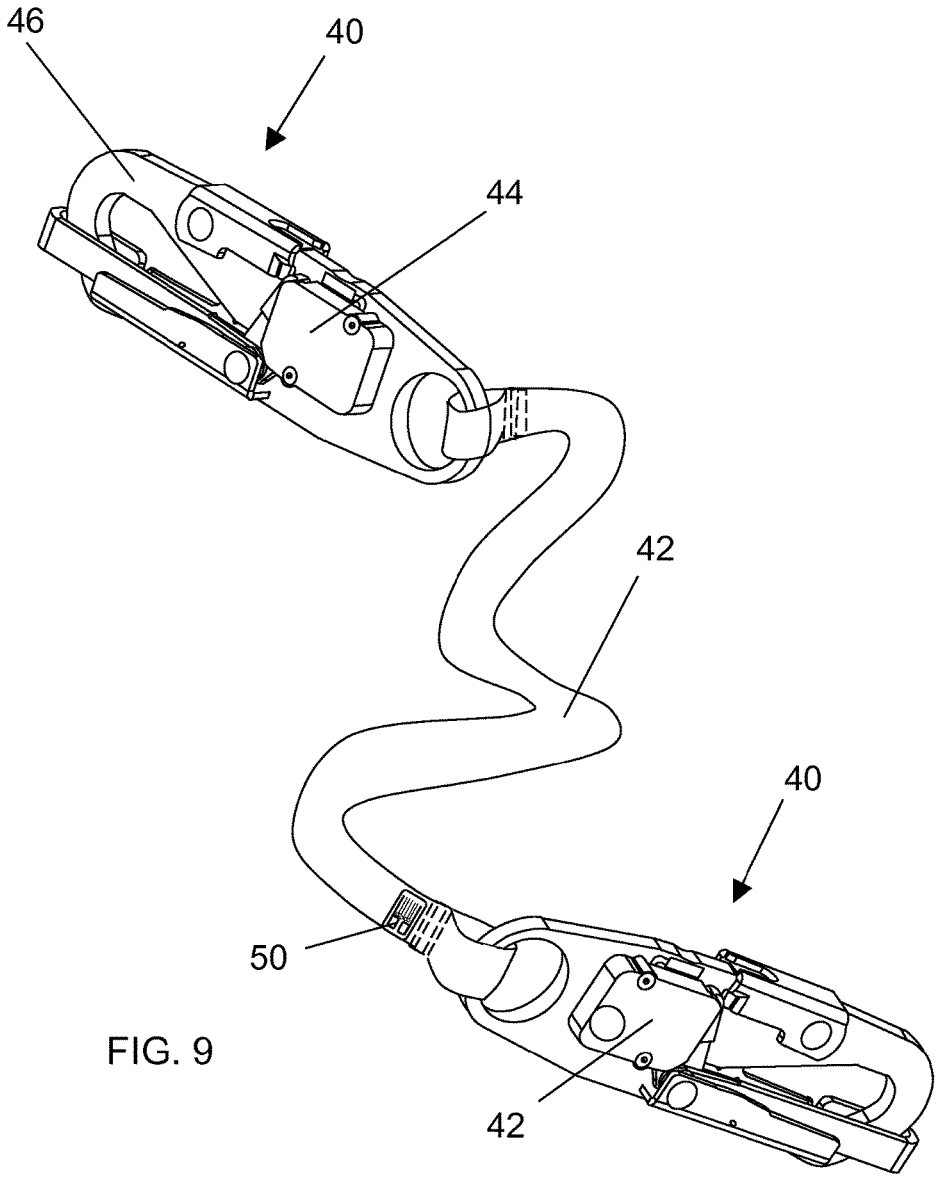
FIG. 9 illustrates a further embodiment of a smart snap safety lanyard of the present invention having a smart snap attached to each end.

In a further embodiment as shown in FIG. 9, the load sensor 50 is a resistive or capacitive strain gauge that is sewn within or otherwise affixed to the fabric of the smart snap lanyard 42. In the event of a fall from the bucket 12, the lanyard 42 will extend to a point sufficient to actuate the load sensor 50 and transmit a signal of activation to the smart snap 40, interface monitoring device 10 or other telematics system or in further embodiments transmit an emergency signal directly to local emergency personal and to company personal including the critical information to assist the rescuers as noted above. Electronics within the lanyard or the smart snap 40 that are attached to one or both ends of the lanyard 42 can store and transmit the emergency signal and information. In further embodiments or additionally, the load sensor 50 may be installed with a load bracket on the D-ring or other attachment point within the bucket 12 and operate similarly as described.

The notification of an accident as soon as possible to emergency personal is critical in saving the lives of lift operators who have fallen out of the aerial lift, although as noted even the fastest rescue may still result in death if it is too late or the rescuers are not adequately trained in the risks of suspension trauma and the proper techniques to revive an operator. To address this risk, a further embodiment of the present invention that will assist the operator in an emergency event is a remote access control affixed to the fall arresting/prevention device to control the aerial lift through a wireless transmission in the event the lift operator falls out of the bucket 12. The remote control 150 operates the aerial lift to raise, lower, retract or extend the boom arm to adequately move the work platform or bucket 12 and save an operator.

Figure 10A:
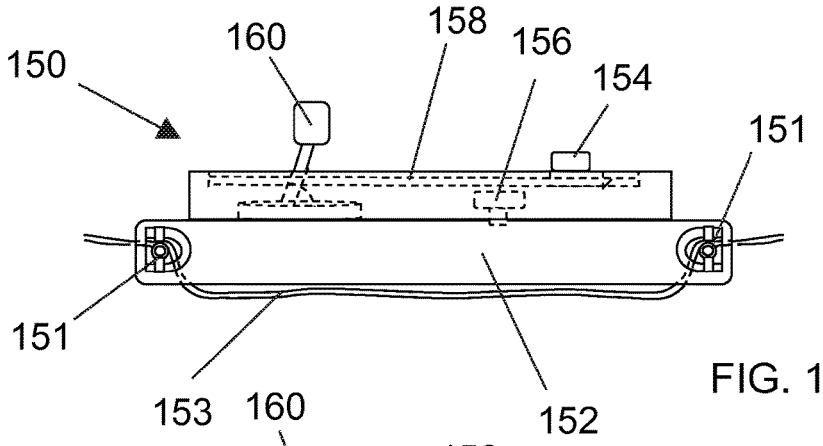
FIGS. 10A-10C illustrate an embodiment of perspective views of a remote control of the present invention.
Figure 10B:
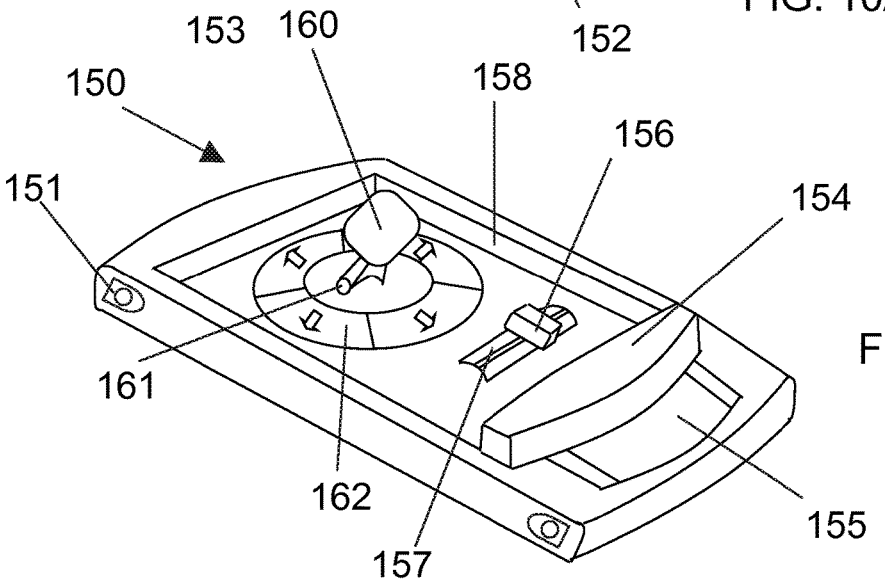
Figure 10C:
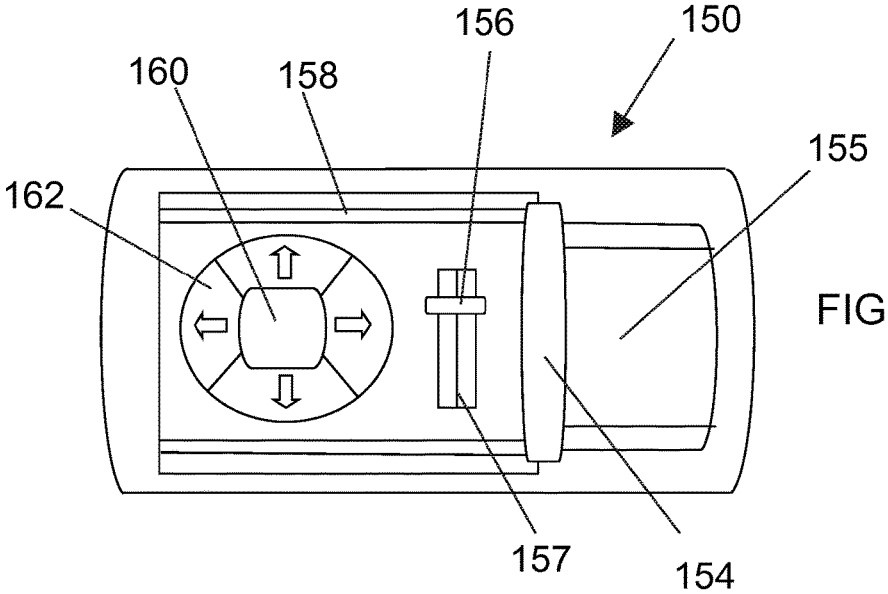

As shown in FIGS. 10A-10C, the remote control device 150 is small and easily affixed to a strap 153 of the safety harness 20 using a roller 151 affixed to either end of an enclosure 152 of the device 150. The strap 153 slides through an opening and around a first roller 151 and along the bottom of the device to a second opening and roller 151 to allow for the remote control device 150 to lay flat against the harness 20 and out of the way from the working operator 14. The remote control device 150 may have a slide cover 155 and handle 154 that protects the controls from activation except when needed in an emergency or as required for maneuverability of the aerial lift by the operator in difficult situations. Using the handle 154, the cover 155 slides along a track 158 on either side of the device to uncover and provide access to the controls. The controls may include a mini-toggle switch 160 that may be pivotally mounted on a hinge 161 to fold down to be stored within the enclosure 152. The toggle switch 160 may provide up, down, retraction and extension controls to move the boom 15 appropriately to lower a dangling operator 14, or to safely maneuver the bucket 12 to free and release an operator that is trapped against a barrier. The remote control 150 may transmit on an accepted radio or wireless frequency to access a receiver within the aerial lift controller 16, truck 18 interface monitoring unit 10, telematics system or other controller device to properly maneuver the bucket 12. In this manner, the remote control 150 may communicate with any aerial lift wireless radio control system or with a wireless emergency lowering system incorporated in the aerial lift or work platform equipment.

Figure 11:
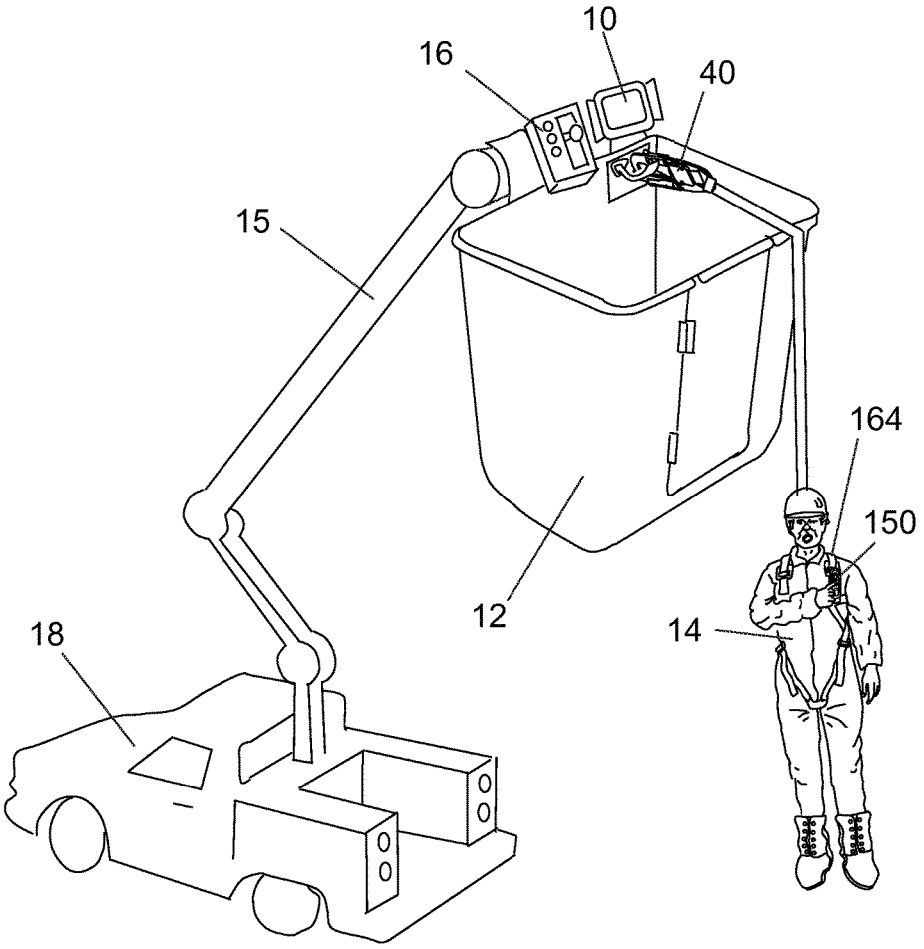
FIG. 11 illustrates an embodiment of an aerial lift bucket with an operator dangling from the platform and operating the remote control of the present invention to maneuver to safety.
Figure 12B:
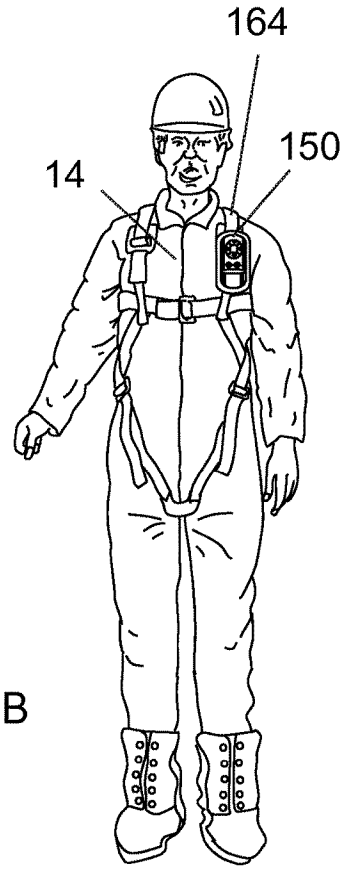
FIGS. 12A and 12B illustrate embodiments of the remote control affixed to a safety harness of the present invention.
Figure 12A:
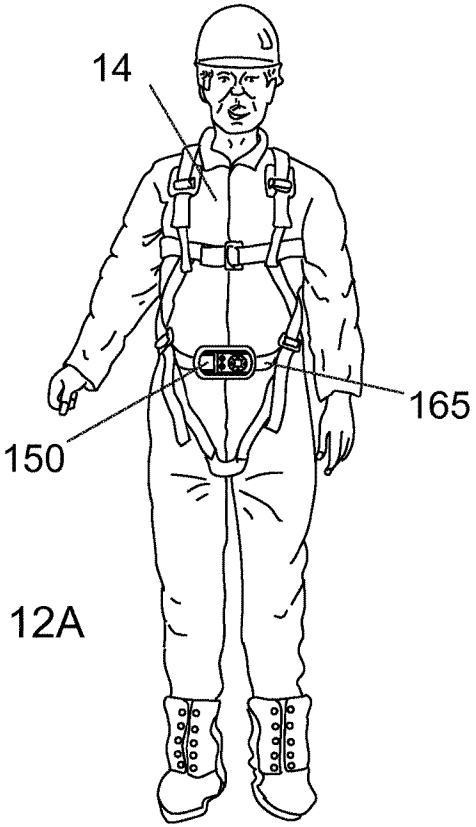

Other controls 156 using a slider 157 or other mechanism restrict movement or limit speed or perform other functions are contemplated within the scope of the present invention and may be included as required and as would be beneficial. Each control is accessible to the operator using one hand if for example the remote control is mounted along the shoulder strap 164 as shown in FIG. 11 or two hands as needed if mounted along the belt 165 as shown in FIG. 12A. In either location as shown in FIGS. 12A and 12B, the remote control 150 is easily accessible in an emergency and may allow for an operator to quickly lower themselves or maneuver the aerial lift to a safe location and in many cases save the operator's life. In further embodiments, remote control of the aerial lift may be performed using a software application installed within a storage device and accessible through a microprocessor on a digital device, so that the operator or a worker close to the accident, or even a supervisor remote from the accident site may rescue the dangling operator by accessing the device on a computer, laptop, tablet, smartphone, iPod, iPad, or other digital device. The remote control application may have a login and password to access and communicate with the aerial lift controls locally, or through a telematics system and operate the emergency lowering control system.

Figure 13:
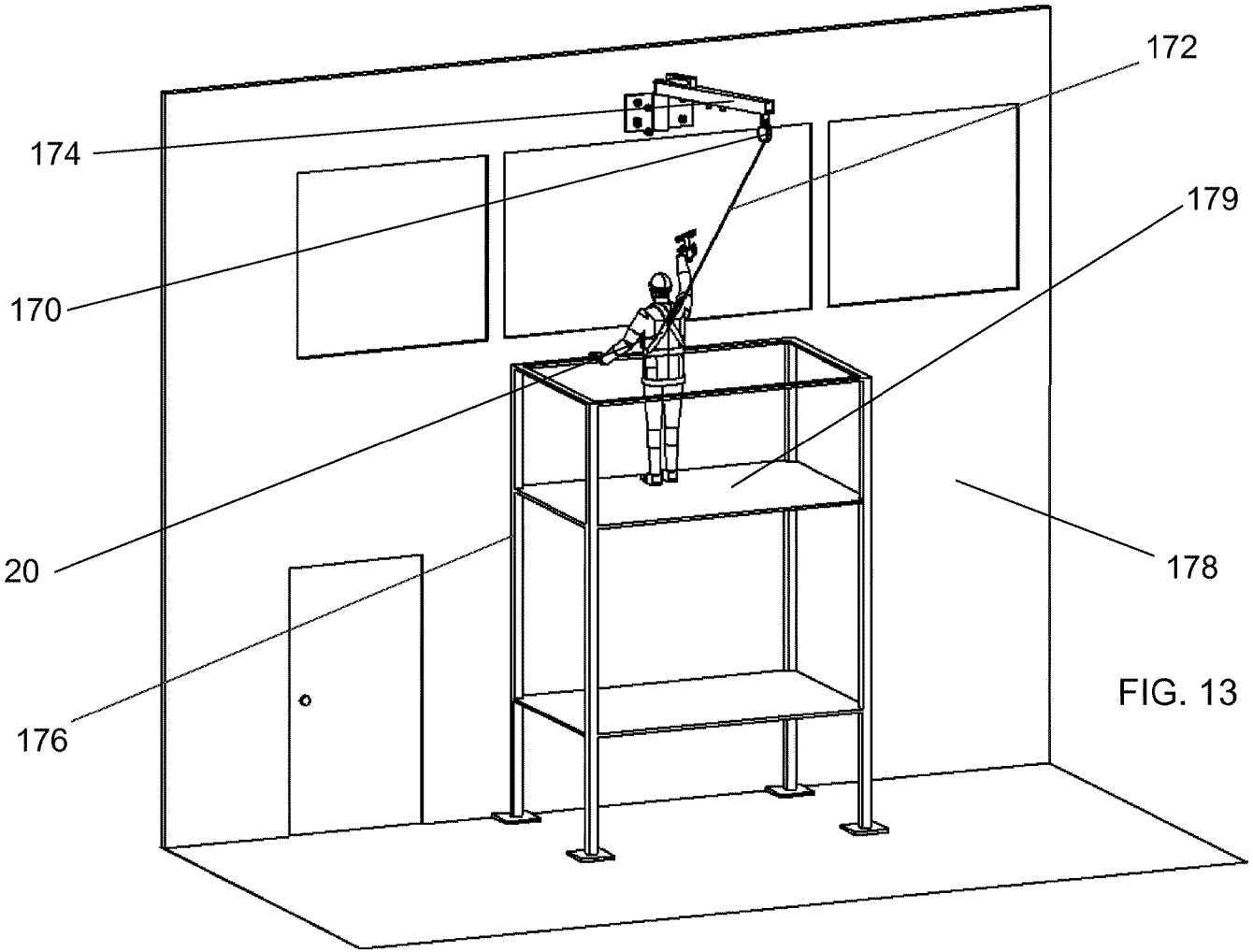
FIG. 13 illustrates an embodiment of a fall prevention device of the present invention using a retractable reel and the smart snap for workers on scaffolding work platforms.
Figure 14A:
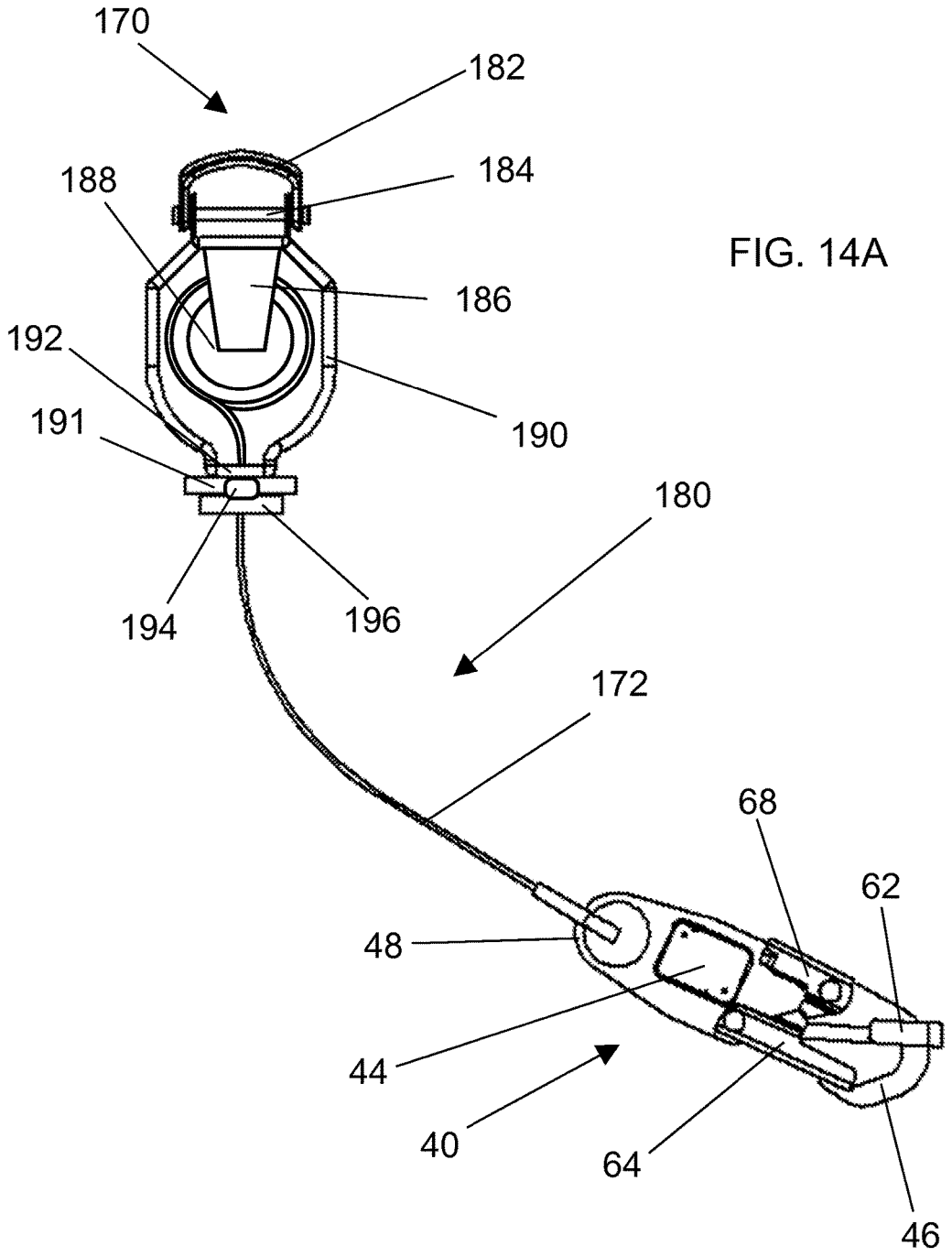
FIG. 14A illustrates an embodiment of a fall prevention device of the present invention using a detection sensor for the retractable reel and the smart snap.
Figure 14B:
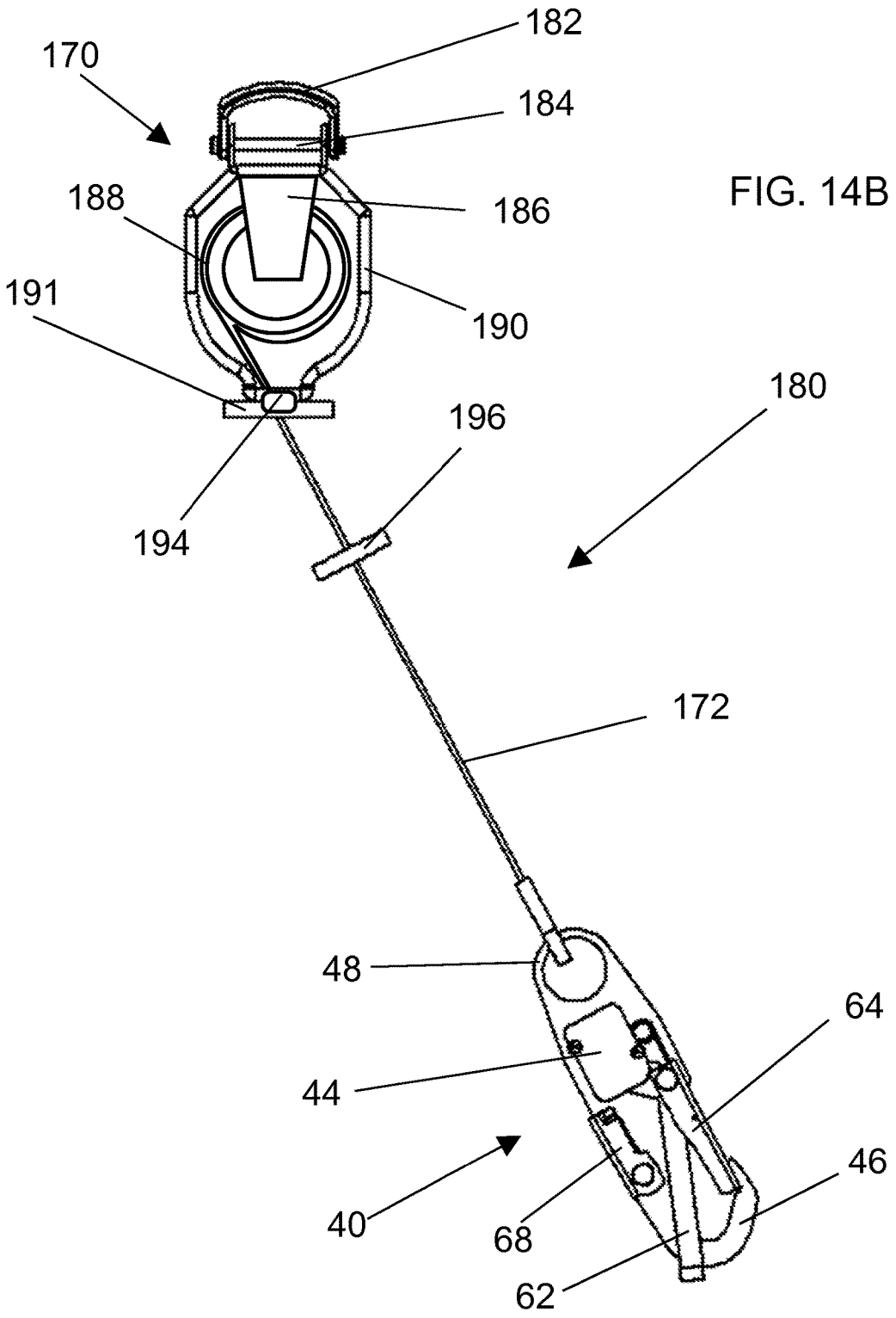
FIG. 14B illustrates an embodiment of a fall prevention device of the present invention using a detection sensor for the retractable reel and the smart snap.

The remote control device 150 and/or software application emergency control system may control a retractable reel 170 to raise or lower an operator on a tether line 172 such as a retractable belt or wire rope that is affixed to an anchor bracket 174 for a worker on suspended or supported scaffolding 176 along the side of a building 178, as shown in FIG. 13. Currently, self-retractable reels 170 for fall protection are manufactured by many companies for use by construction workers, steel workers, building maintenance, roofers, window washers, order selectors, and other workers in elevated work environments. The reel 170 provides the tether line 172 with a snap hook that as shown in FIGS. 14A and 14B may be a smart snap 40 to attach the line 172 to the operator's fall protection harness 20. The reel 170 will provide slack for the operator to perform normal work but if the operator falls, and the speed of extension of the tether line 172 is accelerated, the reel 170 will lock to protect the operator from a continuous fall. The operator will then be suspended from the tether line 172 creating a risk of suspension trauma. The remote control 150 of the present invention controls the reel 170 to hoist the operator back to the work platform 179 or lower the operator to the ground.

Another important feature of the present invention that is not presently used with aerial lift and elevated work platforms is a detection system that provides confirmation that the worker or operator is connected to the tether line 172 on the self-retractable reel 170. The present invention uses the smart snap 40 to confirm attachment of the tether line 172 to the safety harness 20 of the worker, and as described issues verbal warnings and visual alarms to instruct the worker to attach the safety harness 20 in the event the attachment is not detected. In addition to the smart snap 40, a detection system 194 may also be provided at the retractable reel 170. As shown in FIGS. 14A and 14B, an embodiment of the fall protection device for a retractable reel 180 includes an attachment fixture 182 that suspends the reel 170 from the anchor bracket 174 using a connecting bolt 184. The reel includes a brace 186 with an axle that supports a winch 188 with the winch rotating to extend and retract the tether line 172. The brace 186 and winch 188 are supported within the retractable reel frame 190 that has a wire guide 192 at its base 191. The wire guide 192 may have one or more pulleys to align and provide tension to the tether line 172 as a worker pulls the line 172 while moving along the work platform 179.

As a worker pulls to extends the tether line 172, the detection sensor 194 that may be affixed to the base 191 of the frame 190 is activated indicating that the retractable reel 170 is in use. The detection sensor 194 may be for example a Hall Effect Sensor affixed to the base 191 with a magnet 196 secured to the tether line 172. In a closed position, the magnet 196 is near to or in contact with the detector 194. By extending the tether line 172, the magnet 196 is pulled away from the detector 194 causing a change in the output voltage of the Hall Effect Sensor. A wireless transmitter on the detection sensor 194 transmits this voltage change to the interlock controller 44 on the smart snap 40, or in further embodiments to an interlock controller 200 on the retractable reel 170 or to an external server or other computer or digital device.

Figure 15:
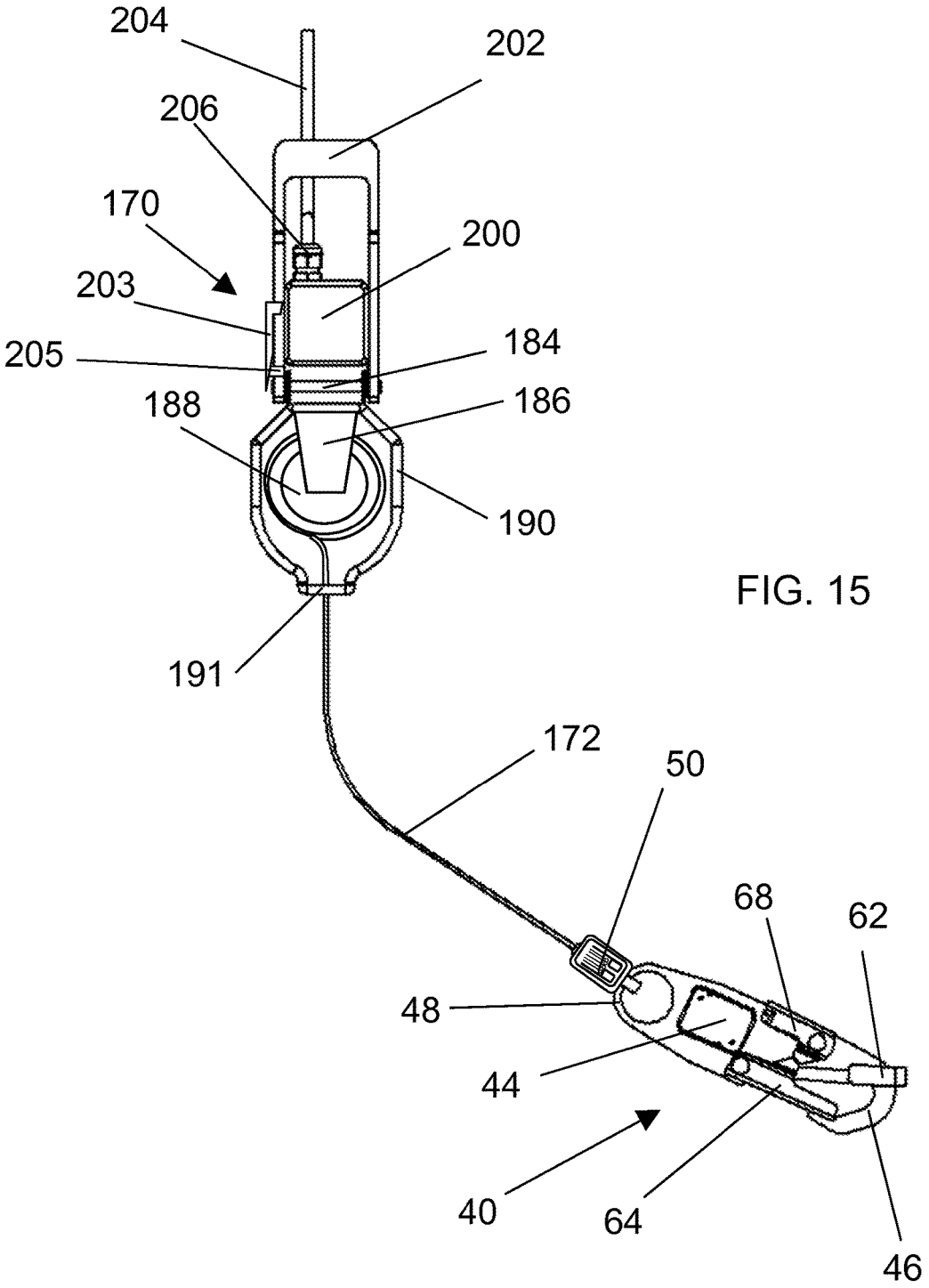
FIG. 15 illustrates a further embodiment of a fall prevention device of the present invention using a detection sensor for the retractable reel, a load sensor, and the smart snap.
Figure 16:
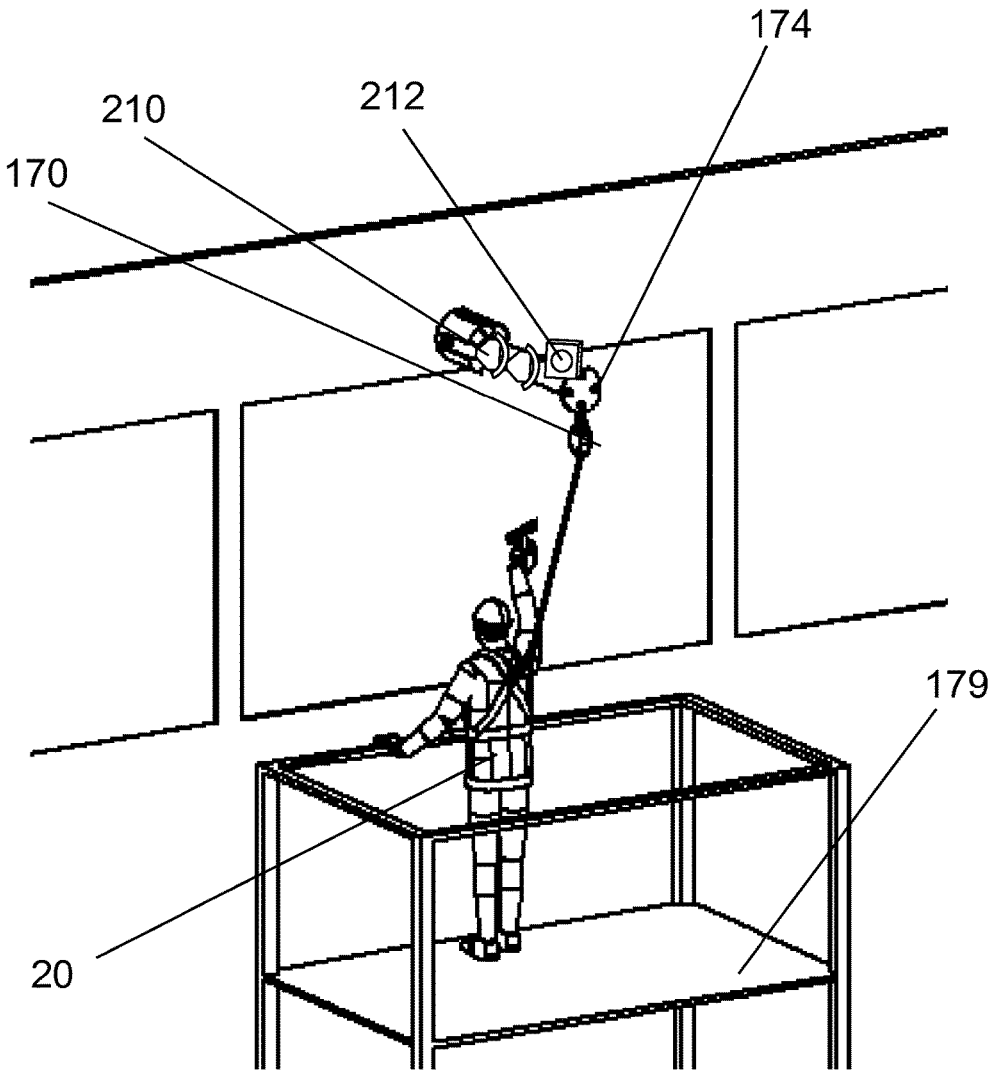
FIG. 16 illustrates an embodiment of a fall prevention device of the present invention using a retractable reel and the smart snap for workers on scaffolding work platforms.

The interlock controller 200, as shown in FIG. 15, may be affixed to the retractable reel 170 to track and store worker and operational information similar to the interlock controller 44 of the smart snap 40. The interlock controller 44 on the smart snap 40 and/or the interlock controller 200 on the retractable reel 170 track each attachment and detachment of the smart snap 40, each activation of the tether line 172, and the time between the attachments and detachments. Worker identification and other information including experience and training data may be retrieved, stored and updated by the interlock controllers 44 and 200 using an autoidentification device 113 and/or RFID tag 45. In order to more fully protect the worker, the interlock controller 200 through a software application installed within the storage device 111 and accessed through the communications interface 117 may prevent activation of the tether line 172 unless an attachment of the smart snap 40 to the safety harness 20 is detected. In this manner, the worker must be attached to the tether line 172 prior to movement of or on the work platform 179. Using the identification information of the operator, the interlock controller 200 may further prevent activation of the tether line 172 if the operator does not have adequate training to operate the work platform. Activation of the tether line 172 and the attachment and detachment of the smart snap 40 or a snap hook may be transmitted to an interface monitoring unit 10, a telematics system or materials management system and be stored in a data log for review. The data log may provide issued warnings to demonstrate adherence by the worker to safety requirements. By reviewing the data log detecting times of attachment and comparing these times to the identity and work hours of the worker, a supervisor may have verification that attachment of the safety harness 20 has not been over ridden and demonstrate that only properly trained workers are on the work platform 179.

The interlock controller 200 may be powered through electrical wiring 204 connected to the interlock controller 200 using connector 206. Importantly, one or more load sensors 50 may be installed and communicate with the interlock controller 200. The load sensors 50 may be installed between the reel 170 and its anchor 174, at the base of the tether line 172, along the tether line 172 or in other locations to activate and transmit an alarm to the interlock controller 200 if the operator falls off of the work platform and is hanging from the safety harness 20. An alarm may produce flashing lights, sonic alarms and verbal warnings as well as transmit an alarm to emergency personnel through for example a 911 call and a call to supervisors of the worker. Indicator lights 210 and a speaker system 212 may be installed to the anchor bracket 174 to indicate a detected connection of the safety harness 20 to the tether line 172; provide instructions and verbal commands if the attachment is not detected, and alert personnel near to the accident to assist a fallen worker as quickly as possible. In further embodiments, the interlock controller 200 on the retractable reel 170 may provide for an activation handle 202 that must be pulled and set into place to allow a worker to extend the tether line 172. Pulling the handle 202 triggers a magnetic, electrical or mechanical switch to transmit a signal to the interlock controller 200 that the tether line 172 is in use. The switch may for example be a mechanical switch 203 that rotates with the handle 202 on a pivot 205 to close an electrical contact and transmit the signal.

Figure 17A:
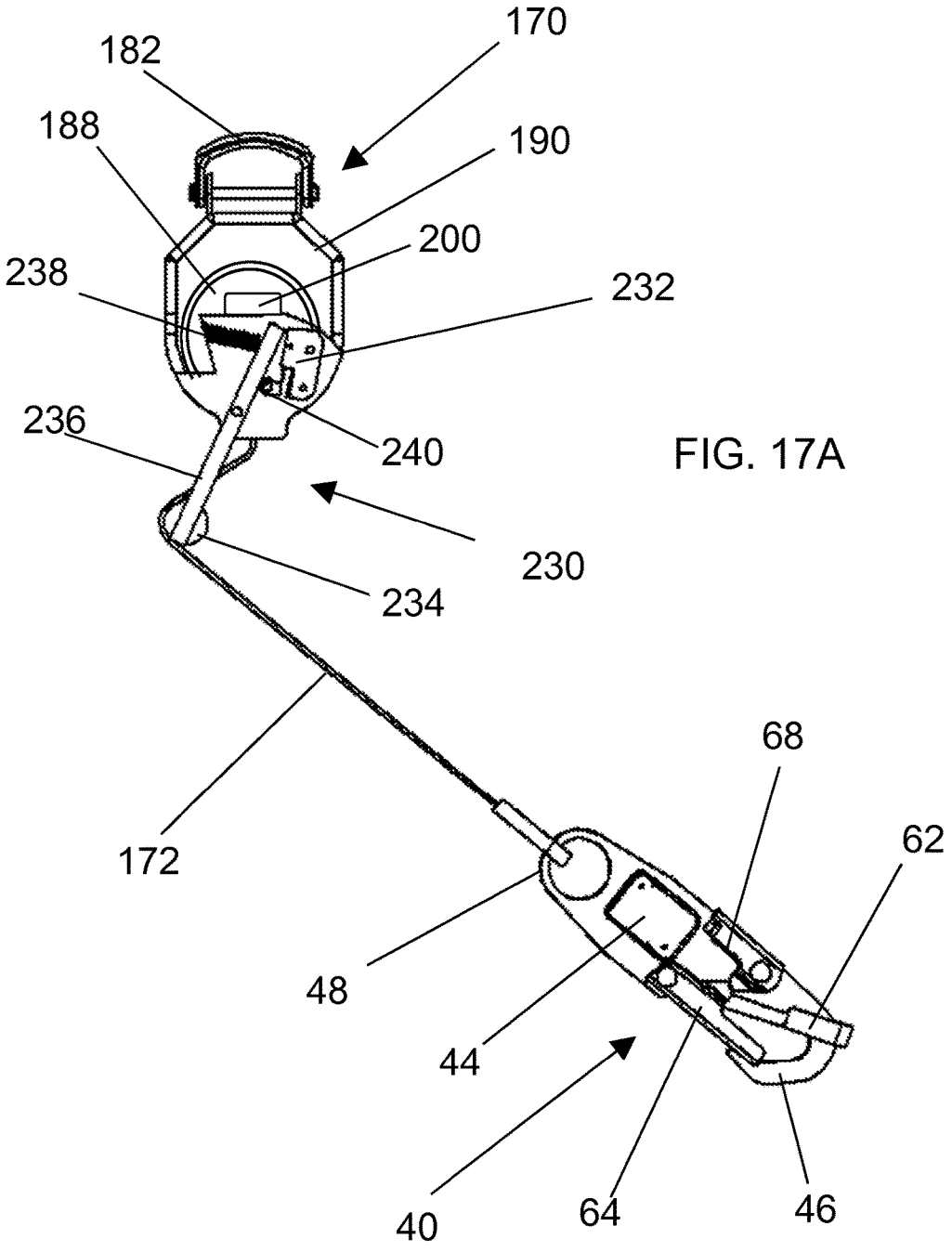
FIG. 17A illustrates a further embodiment of a fall prevention device of the present invention using a load sensor integrated with the retractable reel and the smart snap.
Figure 17B:
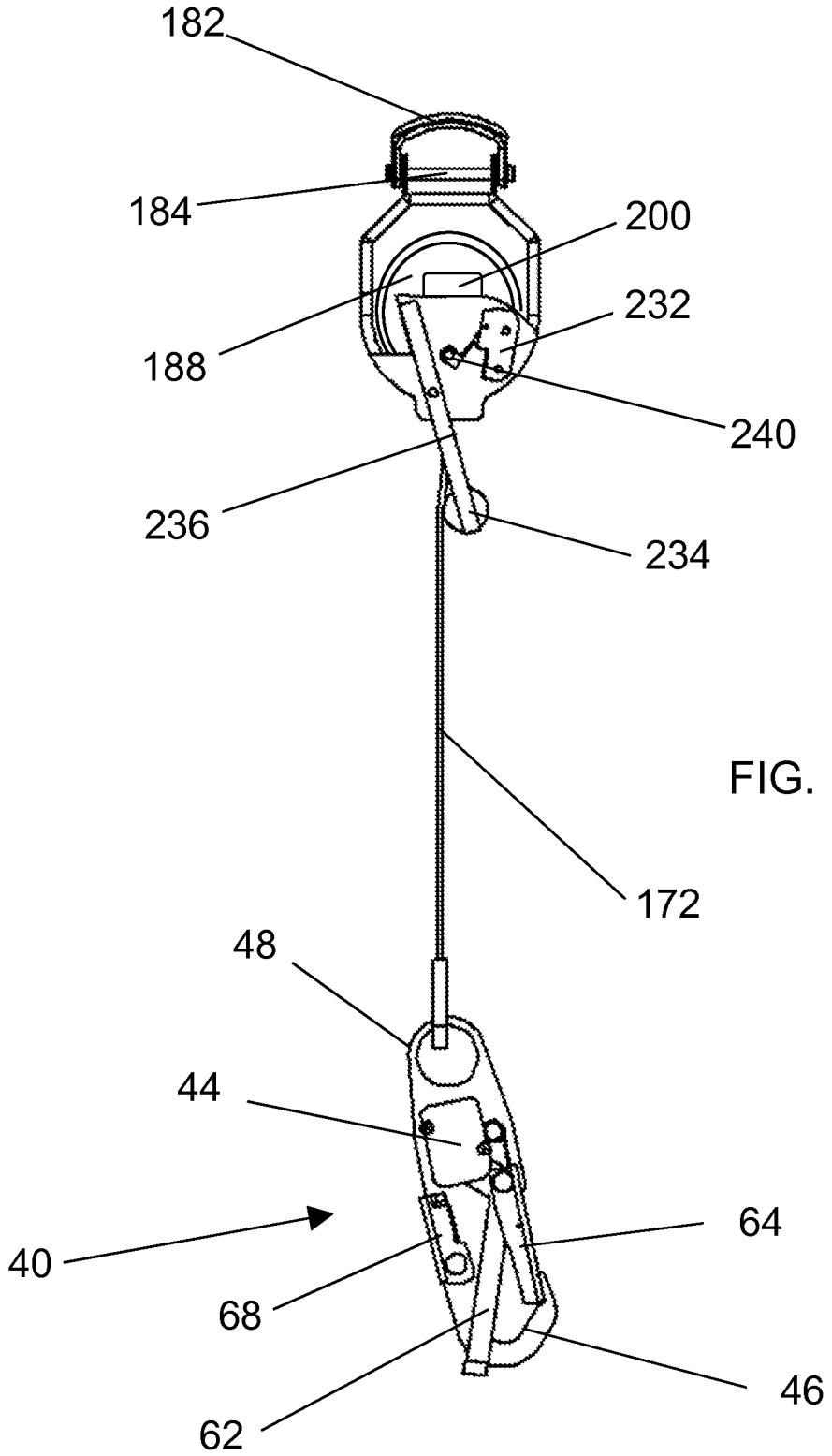
FIG. 17B illustrates a further embodiment of a fall prevention device of the present invention using a load sensor integrated with the retractable reel and the smart snap.

In a further embodiment, the load sensor 230 may be an integrated switch 232 affixed to the retractable reel 170, as shown in FIGS. 17A and 17B. In this embodiment, a pulley 234 and bracket 236 support the tether line 172 so the worker may pull the line freely as the worker moves along the work platform 179. In normal operation, a spring 238 extends to compress the bracket 236 against the integrated switch 232 and hold the switch 232 in a closed position and in contact with an electrical contact 240 at the base of the switch 232. The full force of a worker that has fallen from the work platform 179 is greater than the tension of the spring 238 forcing the bracket 236 away from the switch 232 opening the electrical connection 240 which transmits a signal to the interlock controller 200. The interlock controller 200, transmits an alarm that may produce flashing lights, sonic alarms and verbal warnings as well as transmit an alarm to emergency personnel and supervisors of the worker. The immediate detection of a fall using the integrated switch 232 reduces time for workers within the vicinity to react to the accidental fall and for emergency workers to reach the worker and provide proper medical treatment to reduce injury and possible death due to suspension trauma.

Figure 18:
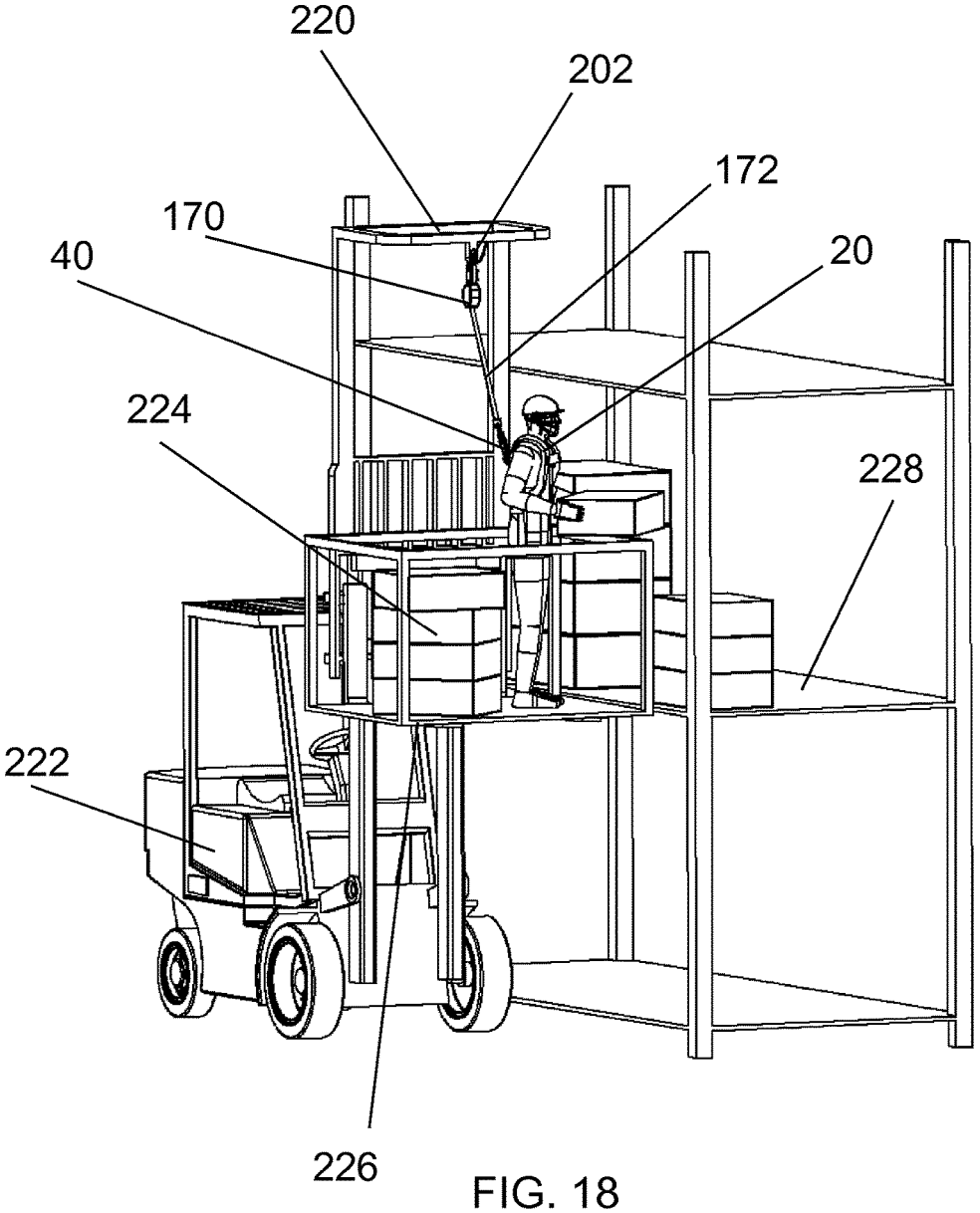
FIG. 18 illustrates an embodiment of a fall prevention device of the present invention using a retractable reel and the smart snap for order pickers using a forklift and work platform.

Other uses of the interlock controller 200 for the retractable reel 170 may be in the installation of the fall prevention system 180 on a forklift support bracket 220 to be used by order pickers that must maneuver a forklift 222 or work platform through a warehouse and collect and transport material 224 as shown in FIG. 18. The forklift carrier 226 elevates the order picker to allow for material to be retrieved from shelving 228 of various heights. The smart snap 40 secures and detects the attachment of the tether line 172 to the safety harness 20 of the order picker or provides verbal warnings and instructions if the attachment is not detected. The interlock controller 200 of the retractable reel 170 can transmit a signal to the interface monitoring unit 10, the forklift controller, a telematics system, or a control switch to lockout or override the forklift or work platform controls and prevent movement until the attachment is detected. Once detected, the handle 202 may be activated to allow the tether line 172 to extend freely from the retractable reel 170.

While a retractable reel 170 locks in the event of an operator or worker falling from a work platform, this safety feature alone does not prevent injury or death from suspension trauma. The additional features of the present invention such as the smart snap 40 and interlock controller 40 and/or 200 that confirms that only trained personnel are in operation of the aerial lift or work platform equipment and that the operator is properly secured to the safety harness and/or tether line 172; the load sensor that immediately transmits an alarm in the event of an accidental fall; and the remote control 150 that allows an operator to maneuver to safety after a fall help to prevent accidents that may cause serious injury or even death.

The invention has been described in detail with particular reference to certain preferred embodiments thereof, but it will be understood that variations and modifications can be effected within the spirit and scope of the invention.

What is claimed is:

1. A safety protection device for aerial lift equipment, comprising:

a safety lanyard comprising a snap hook configured to be attached to an anchor point affixed to a work platform of an aerial lift;

a load sensor attached to the safety lanyard, the load sensor configured to activate if a prescribed load limit is exceeded, the activation of the load sensor triggering the transmission of a warning;

a safety harness attached to the safety lanyard; and a remote control attached to the safety harness, the remote control configured to access the operational controls of the aerial lift to control the movement of the aerial lift; and wherein in the event the load sensor activates, the remote control on the safety harness is accessible to the operator to move the work platform of the aerial lift, wherein the snap hook comprises:

an interlock controller;

a gate hook having a first spring configured to maintain the snap hook in a closed position, a gate switch having a second spring configured to contact the anchor point, a first detection sensor, a second detection sensor on the gate switch, the first detection sensor having a sensor triggered to transmit a signal to the interlock controller when brought within close proximity to the second detection sensor.

2. The safety protection device for aerial lift equipment of claim 1 wherein the remote control is a software application installed on a microprocessor of a digital device.

3. The safety protection device for aerial lift equipment of claim 2 wherein the remote control software application is accessed from a location remote from the aerial lift equipment.

4. The safety protection device for aerial lift equipment of claim 1, wherein the sensor of the first detection sensor is configured to be triggered to transmit said signal to the interlock controller when brought within close proximity to a magnet of the second detection sensor; and wherein the first and second detection sensors are aligned when the gate switch is partially open by the anchor point thereby bringing the magnet of the second detection sensor within close proximity of the first detection sensor triggering the first detection sensor to transmit said signal to the interlock controller when the gate switch is in contact with the anchor point.

5. The safety protection device for aerial lift equipment of claim 1, wherein the snap hook comprises the load sensor.

6. The safety protection device for aerial lift equipment of claim 1, wherein the safety lanyard comprises the load sensor.

7. The safety protection device for aerial lift equipment of claim 1, wherein the safety lanyard is attached to the load sensor.

8. A safety protection device for aerial lift equipment, comprising:

a snap hook for a safety lanyard, the snap hook comprising;

an interlock controller;

a gate hook having a first spring configured to maintain the snap hook in a closed position, a gate switch having a second spring configured to contact an anchor point affixed to a work platform of an aerial lift, a first detection sensor, a second detection sensor on the gate switch, the first detection sensor having a sensor triggered to transmit a signal to the interlock controller when brought within close proximity to the second detection sensor; and a load sensor configured to activate when a load on the safety lanyard exceeds a prescribed force while the safety lanyard is attached to the anchor point; and wherein the first detection sensor is configured to transmit said signal to the interlock controller, the signal being transmitted when the snap hook is attached to the anchor point and when the snap hook is detached from the anchor point;

the load sensor is configured to transmit at least one warning signal when activated; and a remote control configured to access the operational controls of the aerial lift to control the movement of the aerial lift to move the work platform.

9. The safety protection device for aerial lift equipment of claim 8 wherein the interlock controller is configured to transmit at least one second warning signal if the attachment of the snap hook is not detected when movement of the aerial lift equipment is detected.

10. The safety protection device for aerial lift equipment of claim 8 wherein the interlock controller further comprising a storage device and a communications interface and every detection of the attachment and every detection of the detachment of the snap hook to the anchor and all issued warnings are stored in the storage device and transmitted using the communications interface of the interlock controller.

11. The safety protection device for aerial lift equipment of claim 10 wherein the interlock controller further comprises a RFID reader.

12. The safety protection device for aerial lift equipment of claim 10 wherein the communications interface of the interlock controller further comprising a microprocessor to read and write information to and from an autoidentification device.

13. The safety protection device for aerial lift equipment of claim 12 wherein the interlock controller further comprises a software application stored within the storage device and accessible from the microprocessor of the communications interface; and wherein the software application comprises storage of an operator's training records from data received from the autoidentification device, and a second signal is transmitted to lock out controls of the aerial lift if the training of the operator on the aerial lift equipment.

14. The safety protection device for aerial lift equipment of claim 13 wherein the load sensor is installed to the snap hook and transmits the warning signal to the interlock controller to be stored and remotely transmitted using the communications interface.

15. The safety protection device for aerial lift equipment of claim 14 wherein the load sensor is installed on a self-retractable reel.

16. The safety protection device for aerial lift equipment of claim 14 wherein the warning signal is transmitted to emergency personnel.

17. The safety protection device for aerial lift equipment of claim 14 wherein the warning signal comprises the location, identification, and information about the operator.

* * * * *